US009932734B1

(12) United States Patent
Winter

(10) Patent No.: US 9,932,734 B1
(45) Date of Patent: Apr. 3, 2018

(54) DECK COMPONENT WITH POST SLEEVE AND FLANGES

(71) Applicant: Roger Winter, St. John, IN (US)

(72) Inventor: Roger Winter, St. John, IN (US)

( * ) Notice: Subject to any disclaimer, the term of this patent is extended or adjusted under 35 U.S.C. 154(b) by 0 days.

(21) Appl. No.: 15/284,061

(22) Filed: Oct. 3, 2016

(51) Int. Cl.
*E04B 1/24* (2006.01)
*E04B 1/00* (2006.01)
*E04B 1/19* (2006.01)

(52) U.S. Cl.
CPC ..... *E04B 1/2403* (2013.01); *E04B 1/003* (2013.01); *E04B 1/1903* (2013.01); *E04B 2001/1993* (2013.01); *E04B 2001/2406* (2013.01); *E04B 2001/2415* (2013.01); *E04B 2001/2421* (2013.01); *E04B 2001/2466* (2013.01)

(58) Field of Classification Search
CPC ..... E04B 1/2403; E04B 1/003; E04B 1/1903; E04B 2001/1993; E04B 2001/2415; E04B 2001/2421; E04B 2001/2466; E04B 2001/2406
USPC ..... 52/655.1, 843, 844, 845, 848, 656.9
See application file for complete search history.

(56) References Cited

U.S. PATENT DOCUMENTS 949,394 A * 2/1910 Daly ..... E04B 1/2403 135/909
1,915,023 A * 6/1933 Lizaso ..... E04B 1/2403 52/648.1
2,315,516 A 4/1943 Gray
3,592,493 A * 7/1971 Goose ..... B62D 33/044 403/247
3,632,147 A 1/1972 Finger
3,786,612 A * 1/1974 Baker ..... E04C 3/40 403/295
4,092,079 A 5/1978 Swanson
4,125,973 A 11/1978 Lendrihas
4,212,564 A 7/1980 Kay
4,270,872 A 6/1981 Kiyosawa
4,359,851 A 11/1982 Daniels
4,577,449 A * 3/1986 Celli ..... E04B 1/2403 182/186.8
4,614,502 A 9/1986 Nelson
(Continued)

FOREIGN PATENT DOCUMENTS

JP 2006328676 A * 12/2006 ..... E04B 1/2403

OTHER PUBLICATIONS

AS&D Railing Systems, Fascia Mount Brackets, downloaded Sep. 21, 2016 from http://www.thedeckstoreonline.com/step-1-fascia-mount-brackets.html#.WHfsyVPaeUk, website order form (3 pages).

(Continued)

*Primary Examiner* — Brent W Herring
(74) *Attorney, Agent, or Firm* — McDonnell Boehnen Hulbert & Berghoff LLP

(57) ABSTRACT

Deck components comprising a post sleeve and flanges extending away from side walls of the post sleeve are described. The post sleeve has a rectangular cross section. Interior flanges can comprise attachment holes for affixing the interior flanges to box-frame-segments having square-cut edges. Box-frame-segments and box-frame-segment attachments with square-cut edges can abut the exterior surface of a post sleeve side wall. Use of the post sleeve can reduce or eliminate the need to produce beveled joints box-frame-segments and box-frame-segment attachments.

20 Claims, 14 Drawing Sheets

(56) References Cited

U.S. PATENT DOCUMENTS 4,936,068 A 6/1990 VictorSchönfeld et al.
5,289,665 A 3/1994 Higgins
5,315,796 A 5/1994 Gruhlke
5,363,625 A * 11/1994 Philippi ..... E04B 1/5831 403/252
5,494,370 A * 2/1996 Habicht ..... E06B 3/9642 403/231
5,618,127 A * 4/1997 Tonsmann ..... E06B 3/9616 403/230
5,642,595 A 7/1997 Daniels et al.
6,219,989 B1 * 4/2001 Tumura ..... E04B 1/2403 52/274
6,408,587 B2 6/2002 Cronin et al.
6,516,583 B1 * 2/2003 Houghton ..... E04B 1/24 52/167.3
6,837,016 B2 * 1/2005 Simmons ..... E04B 1/2403 403/173
7,021,020 B2 * 4/2006 Simmons ..... E04B 1/2403 52/653.2
7,743,538 B2 6/2010 Parenti et al.
7,806,630 B2 * 10/2010 Hawkins ..... E02B 3/068 405/218
7,883,288 B2 2/2011 Jorna
8,157,480 B2 * 4/2012 Hawkins ..... E02B 3/068 405/218
8,297,023 B2 * 10/2012 Collins ..... E04B 1/24 403/169
8,322,091 B2 * 12/2012 Smith ..... B60J 1/007 49/501
8,453,414 B2 * 6/2013 Simmons ..... E04B 1/2403 403/169
8,745,954 B2 * 6/2014 Simmons ..... E04B 1/2403 403/169
8,782,994 B1 * 7/2014 Simmons ..... E04B 1/2403 403/169
8,863,466 B1 10/2014 Winter
8,966,837 B2 3/2015 Knudsen
8,998,527 B2 * 4/2015 Clark ..... E06B 3/9642 403/231
9,057,190 B1 6/2015 Winter
9,234,365 B2 1/2016 Knudsen
9,272,226 B2 3/2016 Samlaska
9,394,679 B2 * 7/2016 Tanaka ..... E04B 1/2403
9,422,959 B2 * 8/2016 Clark ..... E06B 3/9642
2003/0041549 A1 * 3/2003 Simmons ..... E04B 1/2403 52/655.1
2003/0177735 A1 9/2003 Seeba et al.
2006/0091372 A1 5/2006 Rosian
2006/0144006 A1 * 7/2006 Suzuki ..... E04B 1/2403 52/655.1
2006/0150562 A1 * 7/2006 Simmons ..... E04B 1/2403 52/655.1
2006/0165482 A1 7/2006 Olberding
2006/0265992 A1 * 11/2006 Hiragaki ..... E04B 1/2403 52/633
2007/0245645 A1 10/2007 Nesbitt
2010/0071305 A1 * 3/2010 Collins ..... E04B 1/24 52/704
2010/0170184 A1 * 7/2010 Gadd ..... E04B 1/2612 52/655.1
2010/0175344 A1 * 7/2010 Gadd ..... E04B 1/2612 52/655.1
2012/0110947 A1 * 5/2012 Simmons ..... E04B 1/2403 52/655.1
2012/0131879 A1 5/2012 Bergman
2012/0167518 A1 * 7/2012 Hawkins ..... E02B 3/068 52/655.1
2013/0212958 A1 8/2013 Knudsen
2014/0123588 A1 * 5/2014 Hawkins ..... E02B 3/068 52/655.1
2014/0182233 A1 * 7/2014 Simmons ..... E04B 1/2403 52/655.1
2014/0338280 A1 * 11/2014 Tanaka ..... E04B 1/2403 52/655.1
2014/0373461 A1 12/2014 Rodriguez
2015/0321111 A1 11/2015 Samlaska

OTHER PUBLICATIONS

Lowe's Fiberon HomeSelect White Composite Deck Post Sleeve, downloaded Sep. 21, 2016 from https://www.lowes.com/pd/Fiberon-HomeSelect-White-Composite-Deck-Post-Sleeve-Fits-Common-Post-Measurement-4-in-x-4-in-Actual-4-1-in-x-4-1-in-x-48-in/4196241, website order form (3 pages).

New England Arbors, Bolt Down Bracket System for pergolas, downloaded Sep. 21, 2016 from http://store.newenglandarbors.com/products/bolt-down-bracket-system, website order form, 2016 (5 pages).

Profile Mouldings.com Aluminum Deck Post Wraps, downloaded Sep. 21, 2016 from http://www.profilemouldings.com/Alumnimum-Deck-Post-Wraps-Various-Sizes.aspx, website order form (2 pages).

Simpson Strong-Tie 12-Gauge Black Powder-Coated E-Z Base, downloaded Sep. 21, 2016 from http://www.homedepot.com/p/Simpson-Strong-Tie-12-Gauge-Black-Powder-Coated-E-Z-Base-FPBB44/100655350#!bvstate=ct:r/pg:1/st:p/id:100655350, website order form (4 pages).

InspectAPedia, Guardrails: Guide to Guard Railing Codes, Specifications, Heights, Construction & Inspection, website downloaded Oct. 11, 2017 from the world wide web at https://inspectapedia.com/Stairs/Guardrailing_Codes.php (15 pages).

U.S. Department of Labor, OSHA, letter dated Oct. 28, 2004 from Director of Construction R. Swanson to H. Haydl re stair rail and hand rail heights; §1926.1052(c)(6) and 1926.1052(c)(7) (2 pages).

U.S. Department of Labor, OSHA, memorandum dated Apr. 17, 2006 from Director of Construction R. Swanson to K. Gereke and J. McFee re guardrail height requirements for construction activities in General Industry facilities (2 pages).

Versadeck Decking, Inc., Railing Systems brochure and technical specifications, downloaded Apr. 13, 2017 from the world wide web at http://versadeck.com/products/aluminum_railing.php (6 pages).

Versadeck Decking, Inc., Standard Picket Rail Powder Coated Aluminum Railing System, brochure and technical specifications, Feb. 2, 2014 (9 pages).

* cited by examiner

DECK COMPONENT WITH POST SLEEVE AND FLANGES

BACKGROUND

A deck is a structure typically built outdoors. A deck may be connected to a building. A deck usually has a flat surface similar to a floor and can be built at a given elevation above the ground. A deck can support a load consisting of people, deck furniture, or other items. The supportable load can vary from deck to deck based on such items as the size and type of material used to build the deck.

Some decks, such as decks described in U.S. Pat. No. 9,057,190, are built using box-frame-segments and angle clips. The ends of the box-frame-segments are cut with a bevel so that two of the ends can abut one another to form a bevel or miter joint. Each angle clip can be arranged as an L-shaped clip having angle clip segments that extend from a joint or bend. Each angle clip segment can comprise at least one attachment hole, which can be a through-hole. Each attachment hole within an angle clip segment can correspond to a respective attachment hole within a box-frame-segment. Each angle clip segment can slide or otherwise be inserted into a respective box-frame-segment.

Cutting box-frame-segments with a bevel cut may be tedious and may result in wasting time and material if the bevel cut of the box-frame-segments to be joined together are not performed properly. It would be desirable to be able to join box-frame-segments together without having to join box-frame-segments with bevel cuts.

OVERVIEW

Example embodiments pertaining to and/or including components of decks, as well as example embodiments of assembling and dissembling deck systems and components are described.

In one aspect, an example embodiment can take the form of a deck component comprising: (i) a post sleeve comprising a first side wall, a second side wall, a third side wall, and a fourth side wall, wherein the first side wall abuts the second side wall and the third side wall, wherein the second side wall abuts the first side wall and the fourth side wall, wherein the third side wall abuts the first side wall and the fourth side wall, wherein the fourth side wall abuts the second side wall and the third side wall, and wherein a top of the post sleeve and a bottom of the post sleeve are open for accepting a post into the post sleeve, (ii) a first flange abutting an exterior surface of the first side wall, (iii) a second flange abutting the exterior surface of the first side wall, (iv) a third flange abutting an exterior surface of one of the second side wall, the third side wall, and the fourth side wall, and (v) a fourth flange abutting the exterior surface of the one of the second side wall, the third side wall, and the fourth side wall.

These as well as other aspects and advantages will become apparent to those of ordinary skill in the art by reading the following description with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the drawings.

DETAILED DESCRIPTION

I. Introduction

Figures 1, 2:
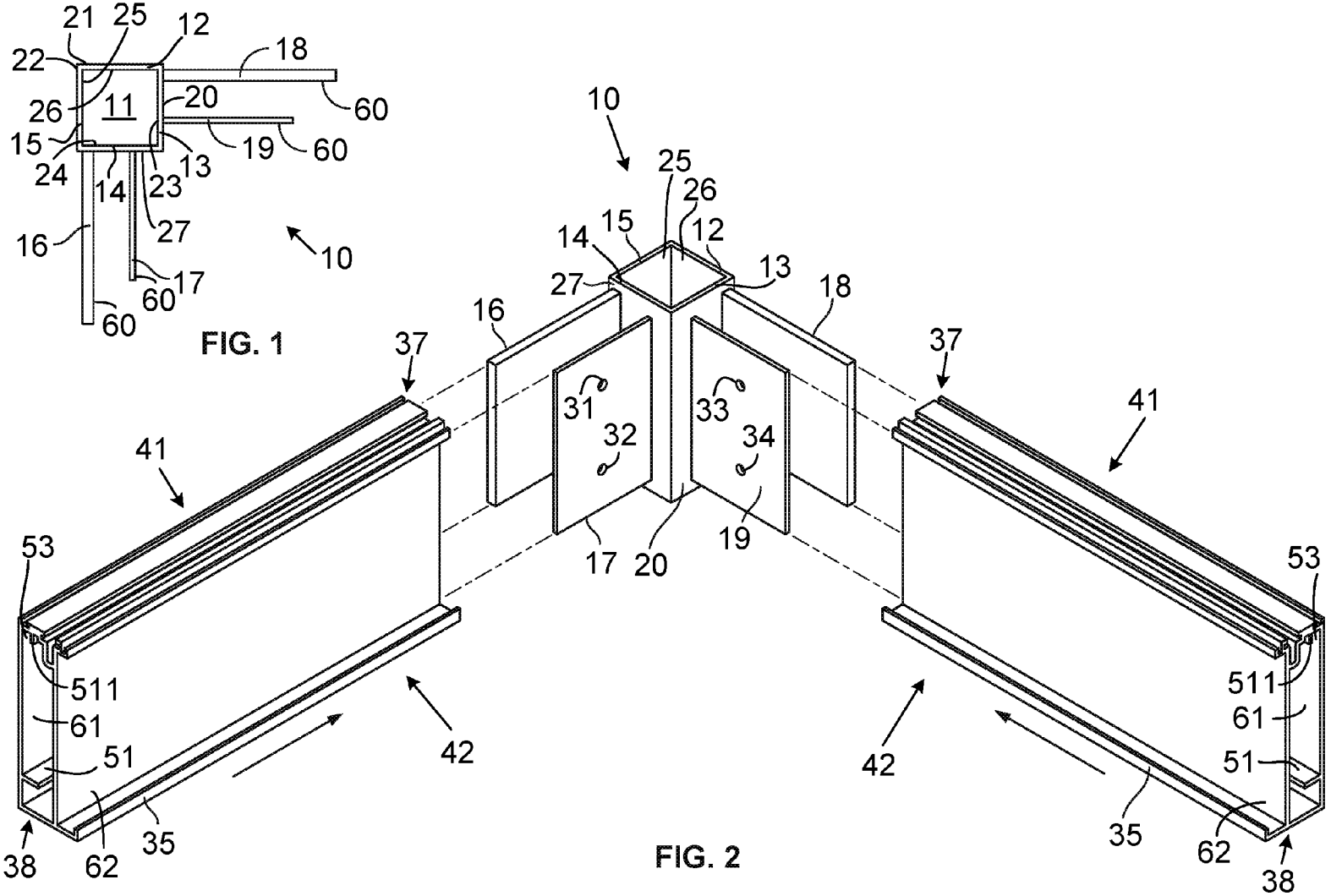
FIG. 1 is a plan view of a post sleeve in accordance with an example embodiment.
FIG. 2 is an isometric view of the post sleeve shown in FIG. 1 and attachable box-frame-segments.

This description describes a variety of components that can be used as part of a structure. The structure can comprise a load-bearing structure such as a deck (e.g., a free-standing deck or a deck attached to another structure such as a house) or a pier (e.g., a pier that is located in a body of water). A pier can comprise a portion that is within a body of water and a portion that is outside of the body of water. The water level with respect to a pier can change. In some instances, a body of water in which a pier is located can be at least partially drained such that the entire pier is outside of a body of water. In such situation, the pier could be considered a deck. Accordingly, for simplicity, the term "deck" in this description means "deck" and/or "pier." The drawings show a variety of deck components. Some aspects in the drawings are not drawn to the same scale. For example, some deck components in the example embodiments can have lengths of about 15.24 centimeters (cm) (i.e., 6 inches) and other components can have lengths of 243.84 cm (i.e., 96 inches) or longer.

The described components comprise a variety of post sleeves. The post sleeves allow for joining two or more box-frame-segments together without having to cut the box-frame-segments to have beveled edges. The box-frame-segments joined at the post sleeves can comprise square cut edges. Cutting the box-frame-segments to have square cut edges is typically easier than cutting box-frame-segments to have beveled edges. The post sleeve includes side walls. The side walls can have dimensions for allowing a post (e.g., a 10.16 cm by 10.16 cm post (i.e., a 4 inch by 4 inch post), or a 15.24 cm by 15.24 cm post (i.e., a 6 inch by 6 inch post)) to be inserted into the post sleeve with sufficient clearance such that the post does not have to be pressed into the post sleeve, yet in proximity to the side walls for affixing the post to the side walls of the post sleeve using fasteners.

The example embodiments described in this description pertain to the deck systems and components and methods of assembling and disassembling deck systems and components described in U.S. Pat. No. 8,863,466, which issued on Oct. 21, 2014 from U.S. patent application Ser. No. 13/973,757 filed Aug. 22, 2013, and described in U.S. Pat. No. 9,057,190, which issued on Jun. 16, 2015 from U.S. patent application Ser. No. 14/598,539 filed Jan. 16, 2015. U.S. Pat. No. 8,863,466 and U.S. Pat. No. 9,057,190 are incorporated herein by reference.

II. Deck Components

FIG. 1 is a plan view of a deck component 10 in accordance with an example embodiment. The deck component 10 may be used within a single story structure, such as a single story deck that attaches to a house via a ledger board or on a cantilevered deck. The deck component 10 may also be used in a multi-story structure if desired.

The deck component 10 comprises a post sleeve 11. The post sleeve 11 comprises side walls 12, 13, 14, and 15. The deck component 10 comprises flanges 16 and 17 that abut the side wall 14, and flanges 18 and 19 that abut the side wall 13. The post sleeve 11 is open above the side walls 12, 13, 14, and 15. The post sleeve 11 is open below the side walls 12, 13, 14, and 15. A post can enter the post sleeve 11 from above the side walls 12, 13, 14, and 15 and/or from below the side walls 12, 13, 14, and 15. Each side wall in the post sleeve 11 comprises an interior surface and an exterior surface. In particular, the side wall 12 has an interior surface 26 and an exterior surface 21, the side wall 13 has an interior surface 23 and an exterior surface 20, the side wall 14 has an interior surface 24 and an exterior surface 27, and the side wall 15 has an interior surface 25 and an exterior surface 22.

As an example, the post sleeve 11 and the flanges 16, 17, 18, and 19 can be formed by extruding a metal billet through a die as a single extruded deck component comprising the post sleeve 11 and the flanges 16, 17, 18, and 19. The flanges 16, 17, 18, and 19 formed by extrusion can be milled to lower the top surfaces of the flanges 16, 17, 18, and 19 below the top surface of the post sleeve 11 and to raise the bottom surfaces of the flanges 16, 17, 18, and 19 above the bottom surface of the post sleeve 11. Milling of the flanges 16, 17, 18, and 19 formed by extrusion allows the flanges 16 and 17 to be positioned within one box-frame-segment 35 shown in FIG. 2 and the flanges 18 and 19 to be positioned within another box-frame-segment 35 shown in FIG. 2.

As another example, the post sleeve 11 and the flanges 16, 17, 18, and 19 can be formed by casting a metal as a single cast deck component comprising the post sleeve 11 and the flanges 16, 17, 18, and 19. The mold used to form the single cast deck component can be formed to minimize or eliminate the need to mill the flanges 16, 17, 18, and 19 to fit within the box-frame-segment 35.

As yet another example, the post sleeve 11 can be formed by extruding or casting a metal and the flanges 16, 17, 18, and 19 can be formed by extruding, casting or rolling a metal. In accordance with this example, the deck component 10 can be formed by affixing the flanges 16, 17, 18, and 19 to the post sleeve 11. The flanges 16 and 17 can be affixed to the post sleeve 11 by welding the flanges 16 and 17 to the exterior surface 27 of the post sleeve 11. The flanges 18 and 19 can be affixed to the post sleeve 11 by welding the flanges 18 and 19 to the exterior surface 20 of the post sleeve 11. FIG. 1 shows weld sides 60 of the flanges 16, 17, 18, and 19.

Welding the weld sides 60 of the flanges 16 and 18 without welding the opposing sides of the flanges 16 and 18 allows the flanges 16 and 18 to be installed within the box-frame-segment 35 flush against the surfaces 62 of the box-frame-segment 35. Similarly, welding the weld sides 60 of the flanges 17 and 19 without welding the opposing sides of the flanges 17 and 19 allows the flanges 17 and 19 to be installed within the box-frame-segment 35 flush against the surfaces 61 of the box-frame-segment 35.

The welds on the flanges 16, 17, 18, and 19 can stop short of the tops and bottoms of the flanges 16, 17, 18, and 19 so that the welds do not interfere with positioning the flanges 16, 17, 18, and 19 within the box-frame-segment 35. For example, the welds for attaching the flanges 16 and 18 may stop short of the tops of flanges 16 and 18 so that the welds do not interfere with the vertical element 511 of the box-frame-segment 35.

As an example, the metal used to form the deck components discussed in this description can comprise aluminum. In additional examples, the metal can comprise a different metal, such as stainless steel or some other alloy. Furthermore, the deck components can be uncoated or coated (e.g., painted).

The deck component 10 can be manufactured with various dimensions. This paragraph lists example dimensions with respect to the deck component 10. A height of the side walls 12, 13, 14, and 15 can be 13.335 cm (i.e., 5.25 inches) and a length of the exterior surface of the side walls 12, 13, 14, and 15 can be 5.08 cm (i.e., 2 inches). Accordingly, the post sleeve 11 can comprise a rectangular cross section. A thickness of the side walls 12, 13, 14, and 15 can be 0.3175 cm (i.e., 0.125 inches) such that a length of the interior surface of the side walls can be 4.445 cm (i.e., 1.75 inches). The flanges 16 and 18 can extend away from the exterior surface 5.08 cm (i.e., 2 inches), have heights of 10.16 cm (i.e., 4 inches) and have thicknesses of 0.635 cm (i.e., 0.25 inches). The flanges 17 and 19 can extend away from the exterior surface 5.715 cm (i.e., 2.25 inches), have heights of 10.795 cm (i.e., 4.25 inches) and have thicknesses of 0.47625 cm (i.e., 0.1875 inches). A shortest distance between two flanges abutting from the same exterior surface can be 1.74625 cm (i.e., 0.6875 inches). A distance from a top of the flanges 16 and 18 to the top of the post sleeve 11 can be 0.635 cm (i.e., 0.25 inches). A distance from a bottom of the flanges 16 and 18 to bottom of the post sleeve 11 can be 2.54 cm (i.e., 1 inch). A distance from a top of the flanges 17 and 19 to the top of the post sleeve 11 can be 0.9525 cm (i.e., 0.375 inches). A distance from a bottom of the flanges 17 and 19 to bottom of the post sleeve 11 can be 1.5875 cm (i.e., 0.625 inches). Other examples of one or more the measurements in this paragraph are possible.

The flange installed into the box-frame segment 35 closer to an exterior side of the box-frame-segment 35 can be thicker and longer to provide support for more lateral and vertical load as compare to the flange that is installed into the box-frame segment 35 closer to the interior side of the box-frame-segment 35. The flange installed into the box-frame segment 35 closer to an exterior side of the box-frame-segment 35 can be offset from a vertical edge of the sider wall to which the flange abuts to account for a thickness of a vertical element 524 of a box-frame segment 35 (shown in FIG. 18) yet allow the exterior side 42 of the box-frame-segment 35 to be flush with an edge of the side wall adjacent to the side wall to which the flanges positioned within the box-frame-segment 35 abut.

Next, FIG. 2 is an isometric drawing showing two box-frame-segments 35 and additional details of the deck component 10. Each box-frame-segment 35 comprises an exterior side 41 and an interior side 42. The exterior sides 42 of the box-frame-segments 35 are the outermost sides of the box-frame-segments 35 when assembled as a box-frame perimeter, such as the box-frame perimeter 200 shown in FIG. 9. The interior sides 42 of the box-frame-segments 35 are the innermost sides of the box-frame-segments 35 when assembled as a box-frame perimeter.

FIG. 2 shows the exterior surface 27 of the side wall 14 and the exterior surface 20 of the side wall 13, as well as the interior surface 25 of the side wall 15 and the interior surface 26 of the side wall 12.

The box-frame-segments 35 comprise an edge 37 and an edge 38. The edges 37 and 38 are square cut. The flanges 16 and 17 can be positioned within one of the box-frame-segments 35. The flanges 18 and 19 can be positioned within the other box-frame-segment 35. The edge 37 being square cut allows for the edge 37 to contact the exterior surface of a side wall, such as the exterior surface 20 or 27. The edge 38 being square cut allows for the edge 38 to contact the exterior surface of the side wall of another deck component comprising a post sleeve. The flanges of the other post sleeve can be positioned within the box-frame-segment 35 at the edge 38.

The flange 17 comprises attachment holes 31 and 32. The flange 19 comprises attachment holes 33 and 34. The attachment holes 31, 32, 33, and 34 can comprise through-holes. The flanges 17 and 19 can comprise a different number of attachment holes. The flanges 16 and 18 may not comprise any attachment holes because it may preferable to not mill attachment holes within the exterior sides 41 of the box-frame-segments 35 for aesthetic reasons. In an alternative arrangement, attachment holes could be milled into the flanges 16 and 18 for placement of fasteners through attachment holes milled into the exterior sides 41.

After the flanges 16 and 17 are positioned within the box-frame-segment 35, fasteners 50 (not shown in FIG. 2) can affix the deck component 10 to the box-frame-segments 35 in which the flanges 16 and 17 have been installed. The attachment holes 31 and 32 can be used as guides to drill corresponding attachment holes within the box-frame-segment 35. The fasteners 50 that affix the deck component 10 to the box-frame-segment 35 can comprise self-tapping screws or another type of fastener. The attachment holes in the box-frame-segment 35 for receiving fasteners placed through attachment holes 31 and 32 could be drilled before the flanges 16 and 17 are positioned within the box-frame-segment 35.

Similarly, after the flanges 18 and 19 are positioned within the box-frame-segment 35, fasteners 50 (not shown in FIG. 2) can affix the deck component 10 to the box-frame-segment 35 in which the flanges 18 and 19 have been installed. The attachment holes 33 and 34 can be used as guides to drill corresponding attachment holes within the box-frame-segment 35. The fasteners 50 that affix the deck component 10 to the box-frame-segment 35 can comprise self-tapping screws or another type of fastener. The attachment holes in the box-frame-segment 35 for receiving fasteners placed through attachment holes 33 and 34 could be drilled before the flanges 18 and 19 are positioned within the box-frame-segment 35.

The box-frame-segments 35 comprise a reinforcement shelf 51 to support a flange, such as flange 16 or 18. The box-frame-segments 35 comprise a flange guide 53 for guiding a flange, such as the flange 16 or 18, within the box-frame-segments 35 during installation of a flange within the box-frame-segments 35.

Figure 3:
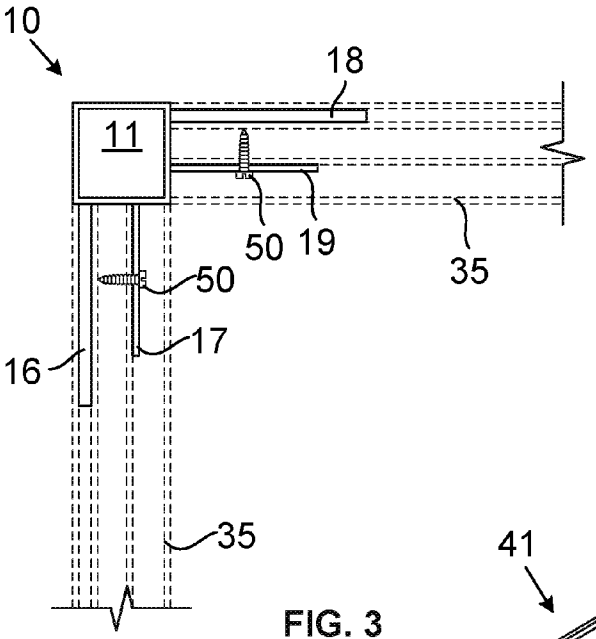
FIG. 3 is a plan view of the post sleeve shown in FIG. 1 with the box-frame-segments shown in FIG. 2 attached to the post sleeve.

Next, FIG. 3 is a plan view of the deck component 10 with the flanges 16 and 17 positioned within one box-frame-segment 35 and the flanges 18 and 19 positioned within another box-frame-segment 35, and fasteners 50 that affix the deck component 10 to the box-frame-segments 35.

Figure 4:
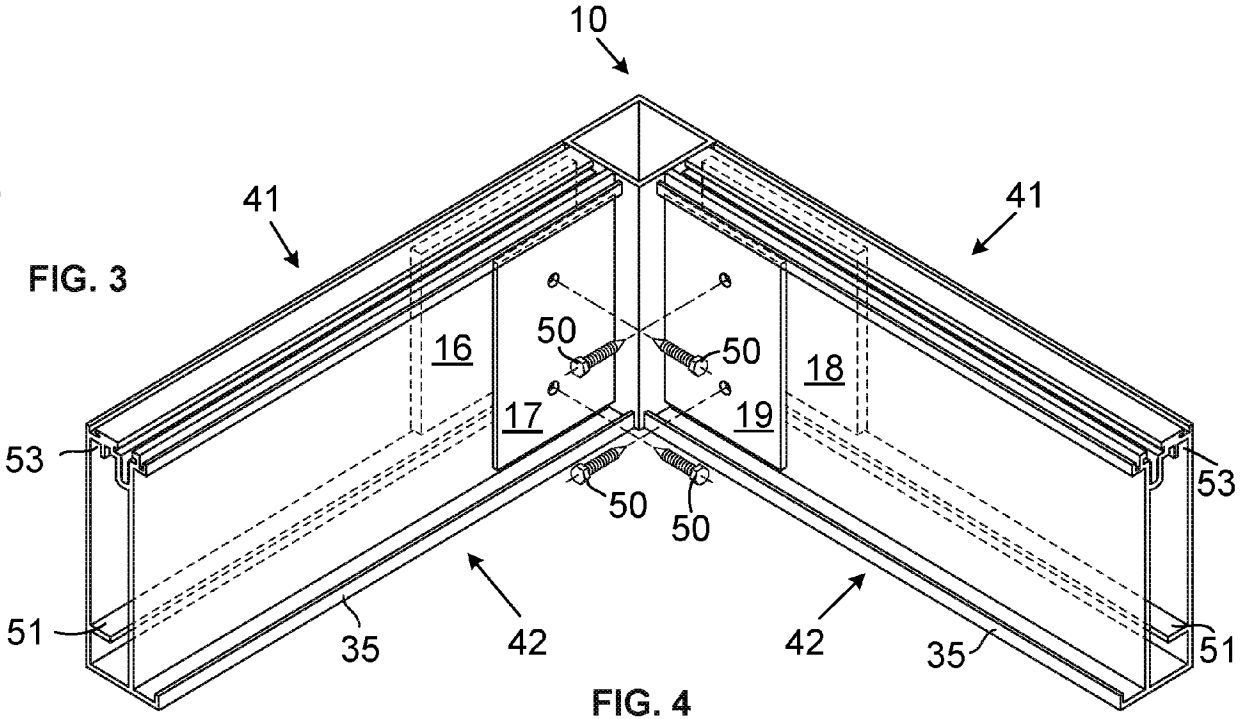
FIG. 4 is an isometric view of the post sleeve and the box-frame-segments shown in FIG. 3.

Next, FIG. 4 is an isometric view of the deck component 10 with the flanges 16 and 17 positioned within one box-frame-segment 35 and the flanges 18 and 19 positioned within another box-frame-segment 35, and fasteners 50 that affix the deck component 10 to the box-frame-segments 35.

Figures 5, 6:
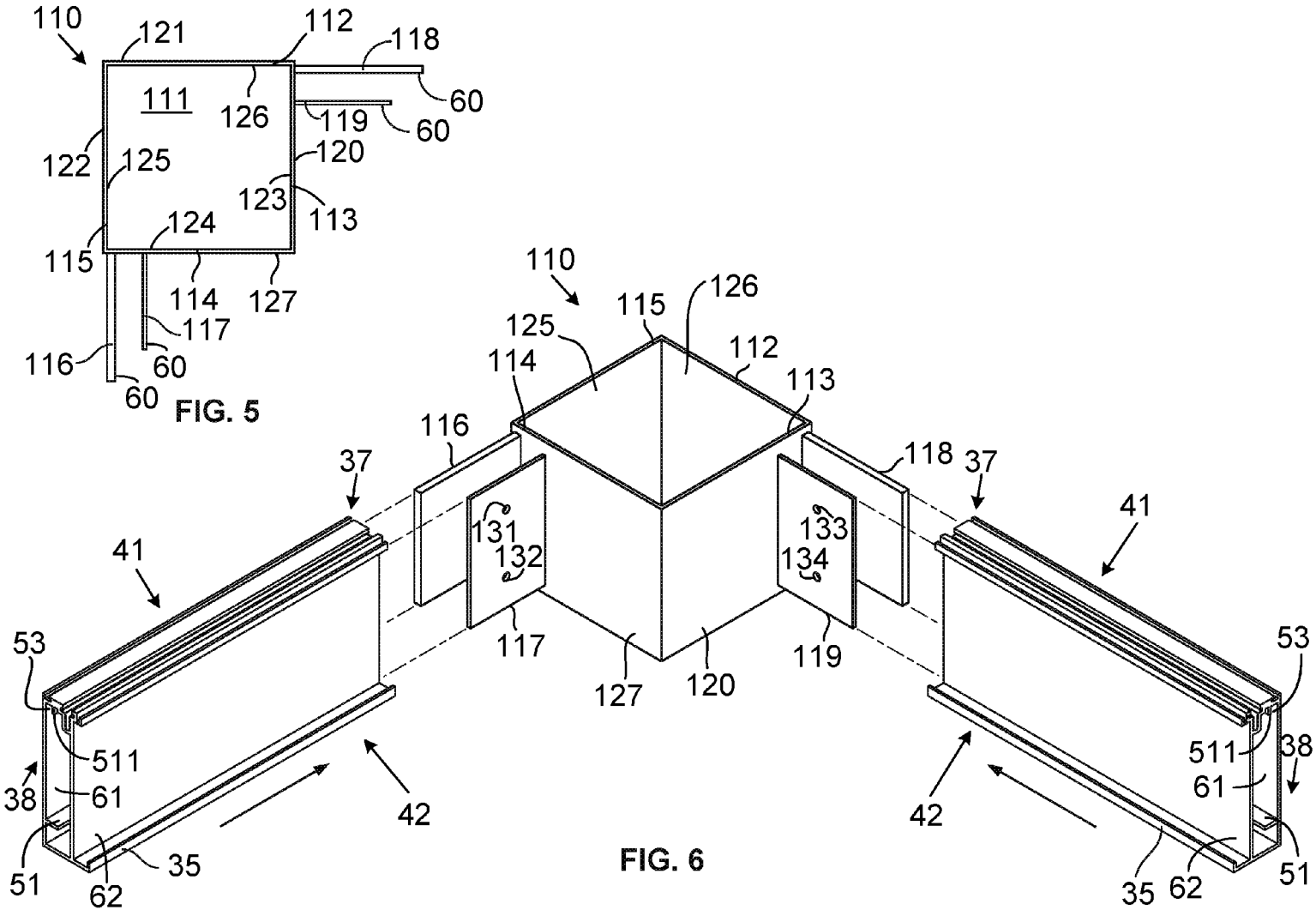
FIG. 5 is a plan view of a post sleeve in accordance with an example embodiment.
FIG. 6 is an isometric view of the post sleeve shown in FIG. 5 and attachable box-frame-segments.

FIG. 5 is a plan view of a deck component 110 in accordance with an example embodiment. The deck component 110 may be used within a multi-story structure, such as a multi-story deck or a single story deck.

The deck component 110 comprises a post sleeve 111. The post sleeve 111 comprises side walls 112, 113, 114, and 115. The deck component 110 comprises flanges 116 and 117 that abut the side wall 114, and flanges 118 and 119 that abut the side wall 113. The post sleeve 111 is open above the side walls 112, 113, 114, and 115. The post sleeve 111 is open below the side walls 112, 113, 114, and 115. A post can enter the post sleeve 111 from above the side walls 112, 113, 114, and 115 and/or from below the side walls 112, 113, 114, and 115. Each side wall in the post sleeve 111 comprises an interior surface and an exterior surface. In particular, the side wall 112 has an interior surface 126 and an exterior surface 121, the side wall 113 has an interior surface 123 and an exterior surface 120, the side wall 114 has an interior surface 124 and an exterior surface 127, and the side wall 115 has an interior surface 125 and an exterior surface 122.

As an example, the post sleeve 111 and the flanges 116, 117, 118, and 119 can be formed by extruding a metal billet through a die as a single extruded deck component comprising the post sleeve 111 and the flanges 116, 117, 118, and 119. The flanges 116, 117, 118, and 119 formed by extrusion can be milled to lower the top surfaces of the flanges 116, 117, 118, and 119 below the top surface of the post sleeve 111 and to raise the bottom surfaces of the flanges 116, 117, 118, and 119 above the bottom surface of the post sleeve 111. Milling of the flanges 116, 117, 118, and 119 formed by extrusion allows the flanges 116 and 117 to be positioned within one box-frame-segment 35 shown in FIG. 6 and the flanges 118 and 119 to be positioned within another box-frame-segment 35 shown in FIG. 6.

As another example, the post sleeve 111 and the flanges 116, 117, 118, and 119 can be formed by casting a metal as a single cast deck component comprising the post sleeve 111 and the flanges 116, 117, 118, and 119. The mold used to form the single cast deck component can be formed to minimize or eliminate the need to mill the flanges 116, 117, 118, and 119 to fit within the box-frame-segment 35.

As yet another example, the post sleeve 111 can be formed by extruding or casting a metal and the flanges 116, 117, 118, and 119 can be formed by extruding, casting or rolling a metal. In accordance with this example, the deck component 110 can be formed by affixing the flanges 116, 117, 118, and 119 to the post sleeve 111. The flanges 116 and 117 can be affixed to the post sleeve 111 by welding the flanges 116 and 117 to the exterior surface 127 of the post sleeve 111. The flanges 118 and 119 can be affixed to the post sleeve 111 by welding the flanges 118 and 119 to the exterior surface 120 of the post sleeve 111. FIG. 5 shows weld sides 60 of the flanges 116, 117, 118, and 119.

Welding the weld sides 60 of the flanges 116 and 118 without welding the opposing sides of the flanges 116 and 118 allows the flanges 116 and 118 to be installed within the box-frame-segment 35 flush against the surfaces 62 of the box-frame-segment 35. Similarly, welding the weld sides 60 of the flanges 117 and 119 without welding the opposing sides of the flanges 117 and 119 allows the flanges 117 and 119 to be installed within the box-frame-segment 35 flush against the surfaces 61 of the box-frame-segment 35.

The welds on the flanges 116, 117, 118, and 119 can stop short of the tops and bottoms of the flanges 116, 117, 118, and 119 so that the welds do not interfere with positioning the flanges 116, 117, 118, and 119 within the box-frame-segment 35. For example, the welds for attaching the flanges 116 and 118 may stop short of the tops of flanges 116 and 118 so that the welds do not interfere with the vertical element 511 of the box-frame-segment 35.

The deck component 110 can be manufactured with various dimensions. This paragraph lists example dimensions with respect to the deck component 110. A height of the side walls 112, 113, 114, and 115 can be 13.335 centimeters (cm) (i.e., 5.25 inches) and a length of the exterior surface of the side walls 112, 113, 114, and 115 can be 10.16 cm (i.e., 4 inches). Accordingly, the post sleeve 111 can comprise a rectangular cross section. A thickness of the side walls 112, 113, 114, and 115 can be 0.3175 cm (i.e., 0.125 inches) such that a length of the interior surface of the side walls can be 4.445 cm (i.e., 1.75 inches). The flanges 116 and 118 can extend away from the exterior surface 5.08 cm (i.e., 2 inches), have heights of 10.16 cm (i.e., 4 inches) and have thicknesses of 0.635 cm (i.e., 0.25 inches). The flanges 117 and 119 can extend away from the exterior surface 5.715 cm (i.e., 2.25 inches), have heights of 10.795 cm (i.e., 4.25 inches) and have thicknesses of 0.47625 cm (i.e., 0.1875 inches). A shortest distance between two flanges abutting from the same exterior surface can be 1.74625 cm (i.e., 0.6875 inches). A distance from a top of the flanges 116 and 118 to the top of the post sleeve 111 can be 0.635 cm (i.e., 0.25 inches). A distance from a bottom of the flanges 116 and 118 to bottom of the post sleeve 111 can be 2.54 cm (i.e., 1 inch). A distance from a top of the flanges 117 and 119 to the top of the post sleeve 111 can be 0.9525 cm (i.e., 0.375 inches). A distance from a bottom of the flanges 117 and 119 to bottom of the post sleeve 111 can be 1.5875 cm (i.e., 0.625 inches). Other examples of one or more the measurements in this paragraph are possible.

Next, FIG. 6 is an isometric drawing showing two box-frame-segments 35 and additional details of the deck component 110. Each box-frame-segment 35 comprises an exterior side 41 and an interior side 42. The exterior sides 42 of the box-frame-segments 35 are the outermost sides of the box-frame-segments 35 when assembled as a box-frame perimeter, such as the box-frame perimeter 200 shown in FIG. 16. The interior sides 42 of the box-frame-segments 35 are the innermost sides of the box-frame-segments 35 when assembled as a box-frame perimeter.

FIG. 6 shows the exterior surface 127 of the side wall 114 and the exterior surface 120 of the side wall 113, as well as the interior surface 125 of the side wall 115 and the interior surface 126 of the side wall 112.

The box-frame-segments 35 comprise an edge 37 and an edge 38. The edges 37 and 38 are square cut. The flanges 116 and 117 can be positioned within one of the box-frame-segments 35. The flanges 118 and 119 can be positioned within the other box-frame-segment 35. The edge 37 being square cut allows for the edge 37 to contact the exterior surface of a side wall, such as the exterior surface 120 or 127. The edge 38 being square cut allows for the edge 38 to contact the exterior surface of the side wall of another deck component comprising a post sleeve. The flanges of the other post sleeve can be positioned within the box-frame-segment 35 at the edge 38.

The flange 117 comprises attachment holes 131 and 132. The flange 119 comprises attachment holes 133 and 134. The attachment holes 131, 132, 133, and 134 can comprise through-holes. The flanges 117 and 119 can comprise a different number of attachment holes. The flanges 116 and 118 may not comprise any attachment holes because it may preferable to not mill attachment holes within the exterior sides 41 of the box-frame-segments 35 for aesthetic reasons. In an alternative arrangement, attachment holes could be milled into the flanges 116 and 118 for placement of fasteners through attachment holes milled into the exterior sides 41.

After the flanges 116 and 117 are positioned within the box-frame-segment 35, fasteners 50 (not shown in FIG. 6) can affix the deck component 110 to the box-frame-segments 35 in which the flanges 116 and 117 have been installed. The attachment holes 131 and 132 can be used as guides to drill corresponding attachment holes within the box-frame-segment 35. The fasteners 50 that affix the deck component 110 to the box-frame-segment 35 can comprise self-tapping screws or another type of fastener. The attachment holes in the box-frame-segment 35 for receiving fasteners placed through attachment holes 131 and 132 could be drilled before the flanges 116 and 117 are positioned within the box-frame-segment 35.

Similarly, after the flanges 118 and 119 are positioned within the box-frame-segment 35, fasteners 50 (not shown in FIG. 6) can affix the deck component 110 to the box-frame-segment 35 in which the flanges 118 and 119 have been installed. The attachment holes 133 and 134 can be used as guides to drill corresponding attachment holes within the box-frame-segment 35. The fasteners 50 that affix the deck component 110 to the box-frame-segment 35 can comprise self-tapping screws or another type of fastener. The attachment holes in the box-frame-segment 35 for receiving fasteners placed through attachment holes 133 and 134 could be drilled before the flanges 118 and 119 are positioned within the box-frame-segment 35.

The box-frame-segments 35 comprise a reinforcement shelf 51 to support a flange, such as flange 116 or 118. The box-frame-segments 35 comprise a flange guide 53 for guiding a flange, such as the flange 116 or 118, within the box-frame-segments 35 during installation of a flange within the box-frame-segments 35.

Figure 7:
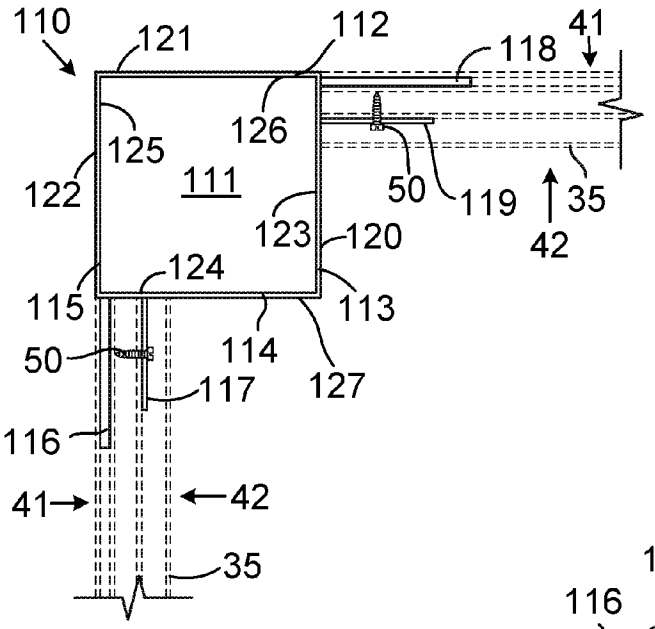
FIG. 7 is a plan view of the post sleeve shown in FIG. 5 with the box-frame-segments shown in FIG. 6 attached to the post sleeve.

Next, FIG. 7 is a plan view of the deck component 110 with the flanges 116 and 117 positioned within one box-frame-segment 35 and the flanges 118 and 119 positioned within another box-frame-segment 35, and fasteners 50 that affix the deck component 110 to the box-frame-segments 35.

Figure 8:
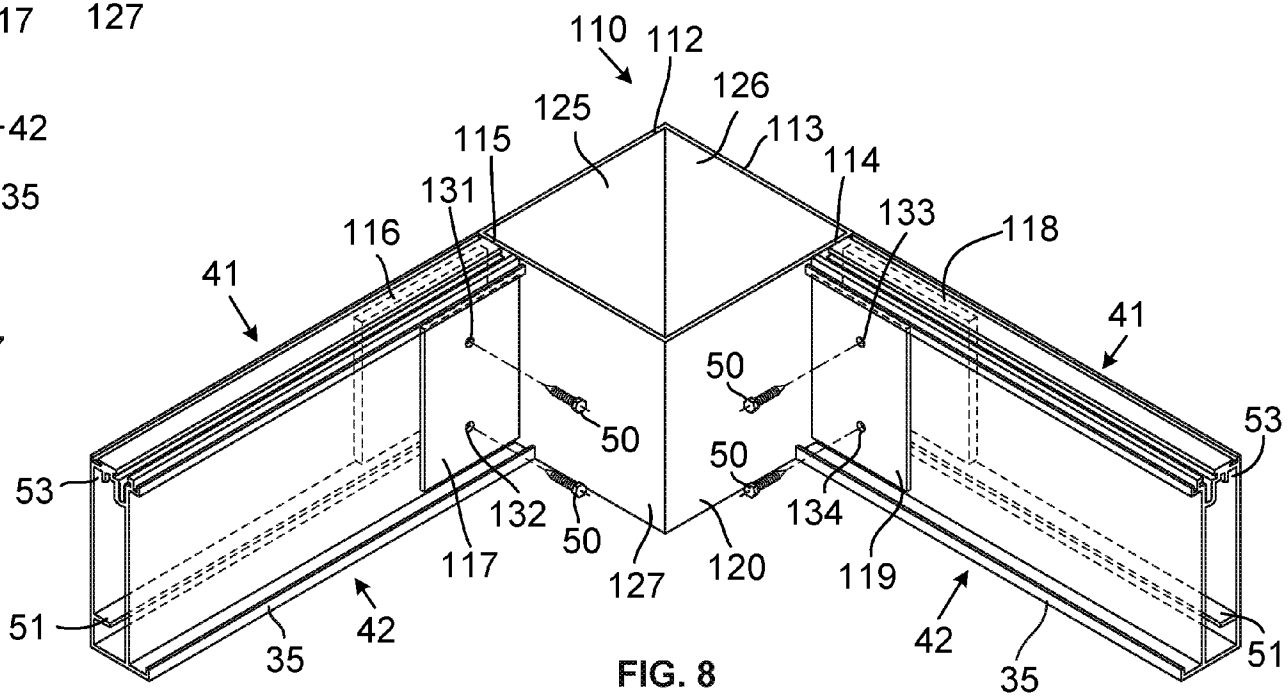
FIG. 8 is an isometric view of the post sleeve and the box-frame-segments shown in FIG. 7.

Next, FIG. 8 is an isometric view of the deck component 110 with the flanges 116 and 117 positioned within one box-frame-segment 35 and the flanges 118 and 119 positioned within another box-frame-segment 35, and fasteners 50 that affix the deck component 110 to the box-frame-segments 35.

Figure 9:
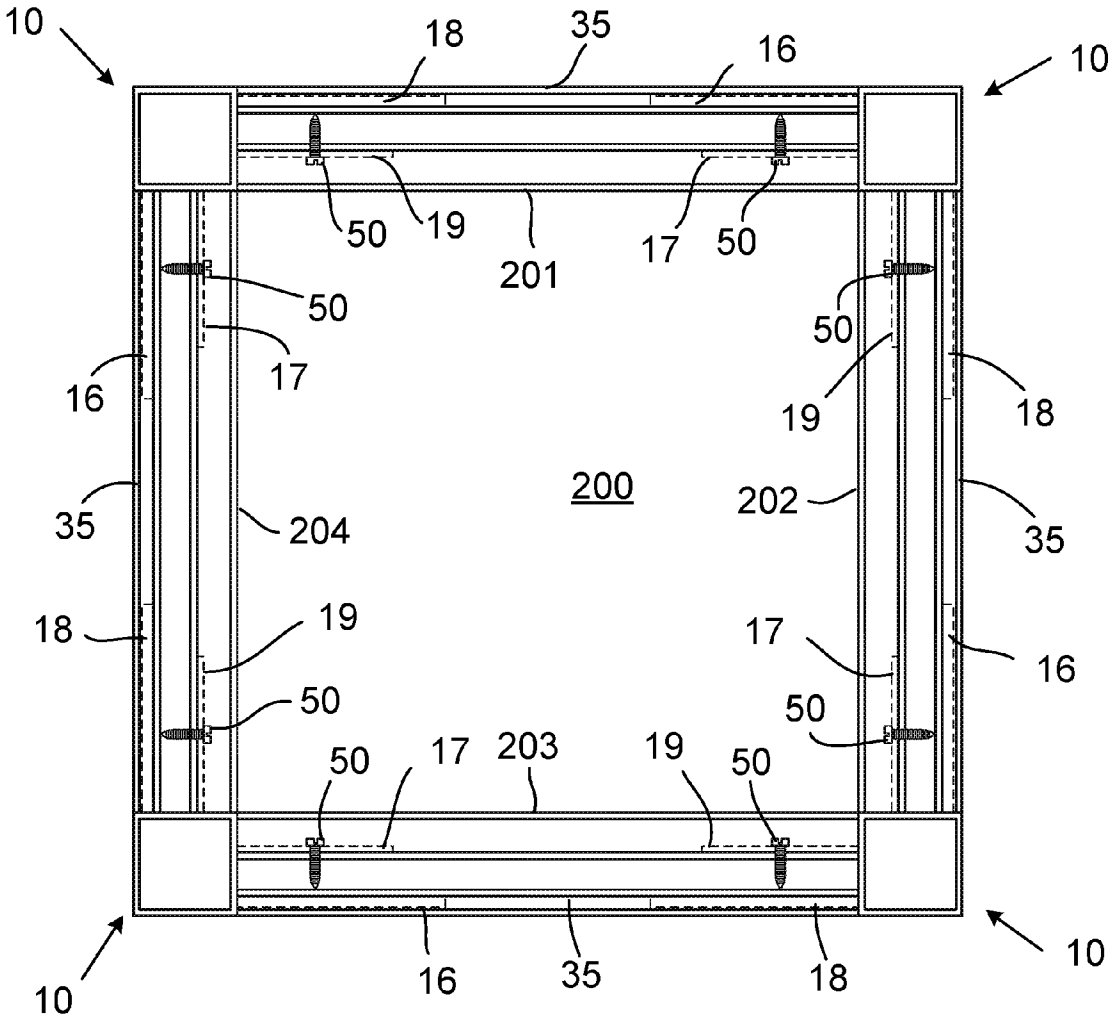
FIG. 9 is a plan view of a box-frame perimeter comprising multiple post sleeves and box-frame-segments.

Next, FIG. 9 is a plan view of a box-frame-perimeter 200. The box-frame-perimeter 200 comprises four deck components 10 and four box-frame-segments 35. Each of the box-frame segments 35 of the box-frame-perimeter 200 connects to two of the deck components 10. Each of the box-frame-segments 35 of the box-frame-perimeter 200 has a box-frame-segment attachment 201, 202, 203, or 204 attached. Each of the box-frame-segment attachments 201, 202, 203, or 204 can comprise one or more box-frame-segment attachments. Each box-frame-segment attachment of the box-frame-segment attachments 201, 202, 203, or 204 can be configured like the box-frame-segment attachment 526 show in FIG. 18. Joists (not shown) can be attached to two opposing box-frame-segment attachments, such as the box-frame-segment attachments 202 and 204. Deck boards (not shown) can be affixed to the box-frame-perimeter 200.

A box-frame perimeter including deck components 10 could include other deck components including a post sleeve. For example, a box-frame perimeter could comprise a deck component 75 (shown in FIG. 11) to connect the upper box-frame segment 35 shown in FIG. 9 and another deck component 75 to connect the lower box-frame-segment 35 shown in FIG. 9 if a span of the upper and lower box-frame-segments 35 require additional posts to support the box-frame-segments due to the length of a span of the upper and lower box-frame-segments shown in FIG. 9. In this regard, the upper and lower box-frame-segments 35 can be cut into multiple box-frame-segments with square cut edges for connection to a deck component 10 and a deck component 75, or a deck component 125 shown in FIG. 12 or a deck component 260 shown in FIG. 13.

Figure 10:
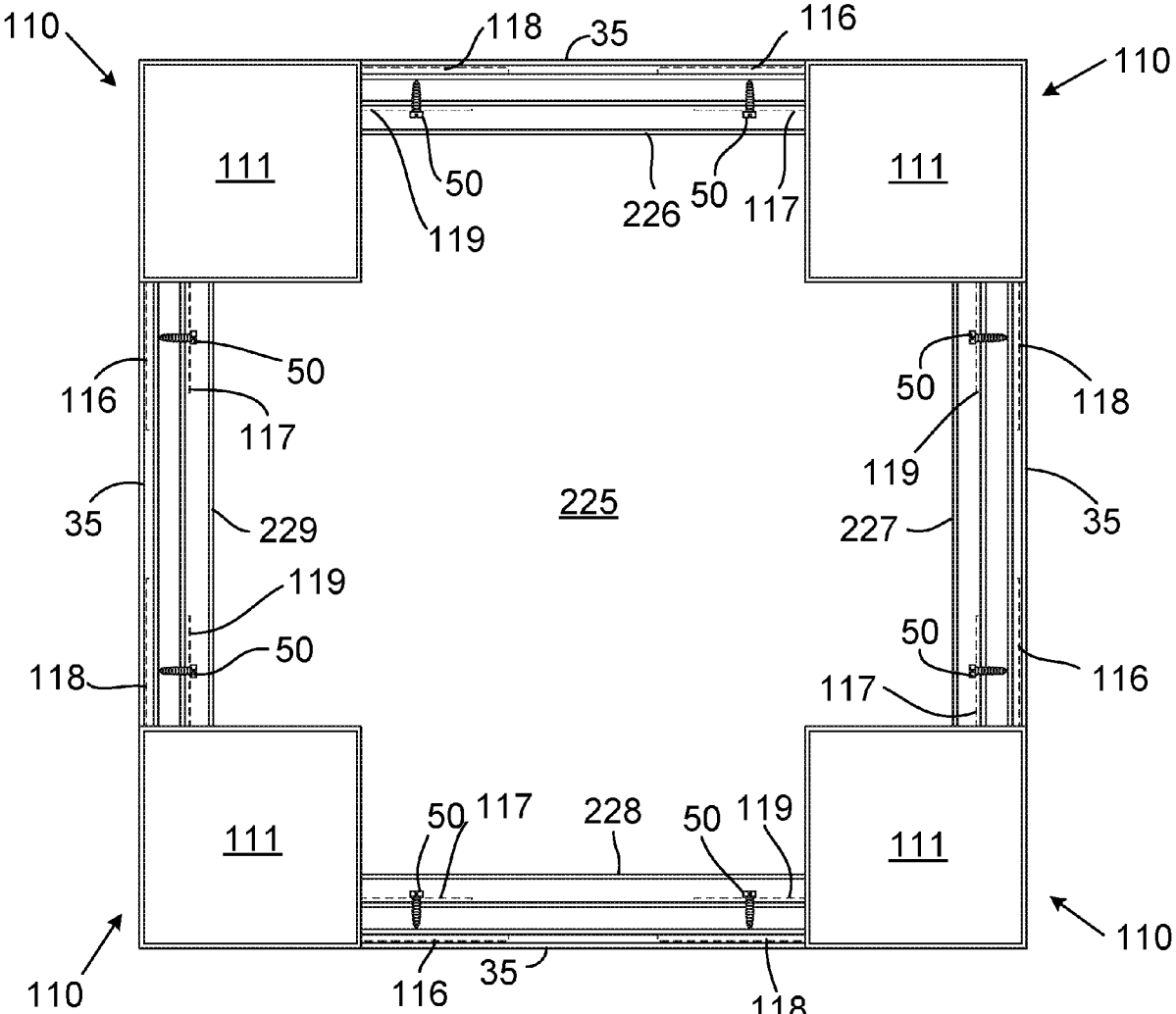
FIG. 10 is a plan view of a box-frame perimeter comprising multiple post sleeves and box-frame-segments.

Next, FIG. 10 is a plan view of a box-frame-perimeter 225. The box-frame-perimeter 225 comprises four deck components 110 and four box-frame-segments 35. Each of the box-frame segments 35 of the box-frame-perimeter 225 connects to two of the deck components 110. Each of the box-frame-segments 35 of the box-frame-perimeter 225 has a box-frame-segment attachment 226, 227, 228, or 229 attached. Each of the box-frame-segment attachments 226, 227, 228, or 229 can comprise one or more box-frame-segment attachments. Each box-frame-segment attachment of the box-frame-segment attachments 226, 227, 228, or 229 can be configured like the box-frame-segment attachment 526 show in FIG. 18. Joists (not shown) can be attached to two opposing box-frame-segment attachments, such as the box-frame-segment attachments 227 and 229. Deck boards (not shown) can be affixed to the box-frame-perimeter 225.

A box-frame perimeter including deck components 110 could include other deck components including a post sleeve. For example, a box-frame perimeter could comprise a deck component 315 (shown in FIG. 14) to connect the upper box-frame segment 35 shown in FIG. 10 and another deck component 315 to connect the lower box-frame-segment 35 shown in FIG. 10 if a span of the upper and lower box-frame-segments 35 require additional posts to support the box-frame-segments due to the length of a span of the upper and lower box-frame-segments shown in FIG. 10. In this regard, the upper and lower box-frame-segments 35 can be cut into multiple box-frame-segments with square cut edges for connection to a deck component 110 and a deck component 315, or a deck component 350 shown in FIG. 15 or a deck component 400 shown in FIG. 16.

Figure 11:
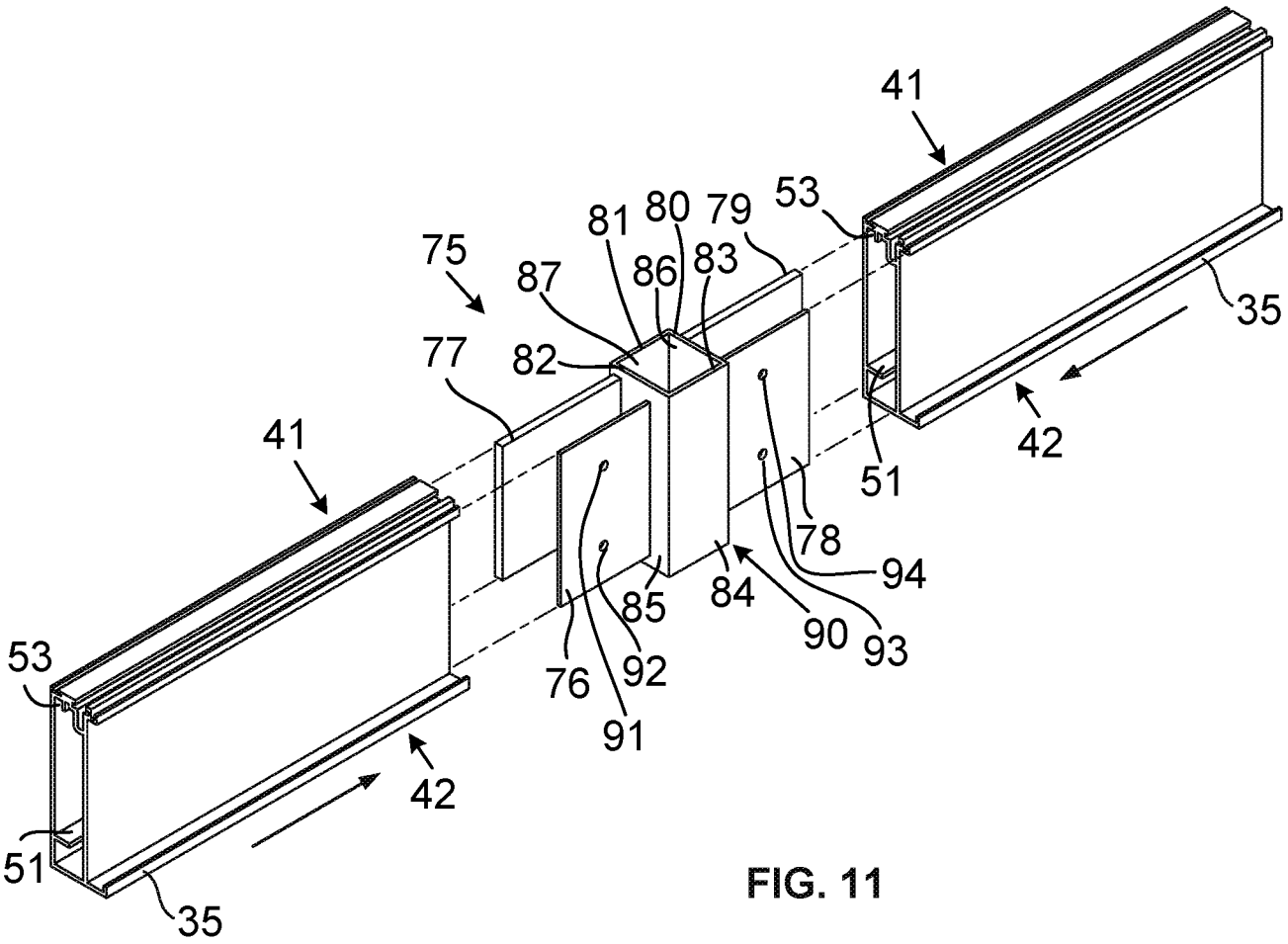
FIG. 11, FIG. 12, FIG. 13, FIG. 14, FIG. 15, FIG. 16, and FIG. 17 are isometric views of a post sleeve and the box-frame-segments in accordance with additional example embodiments.
Figure 12:
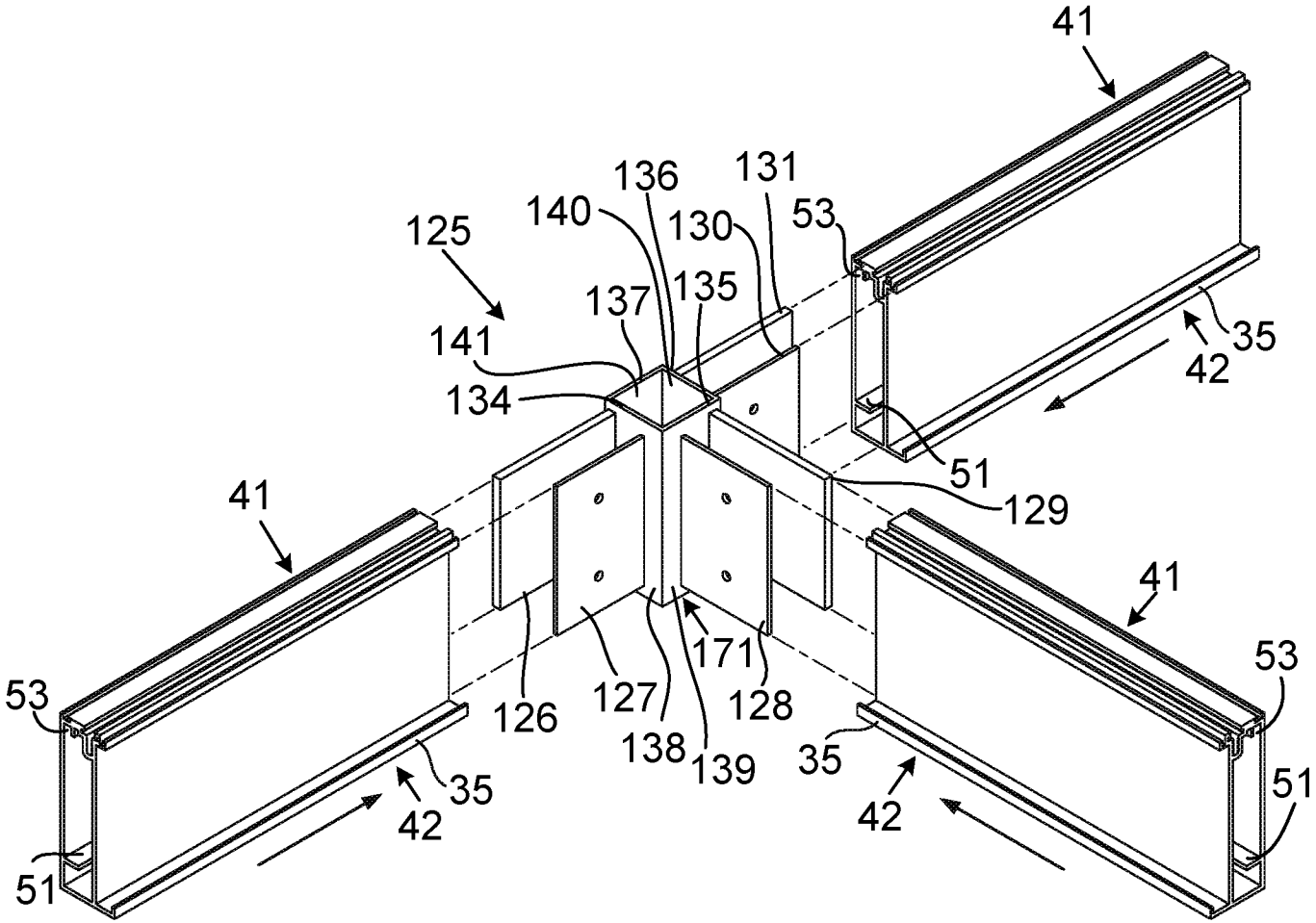
Figure 13:
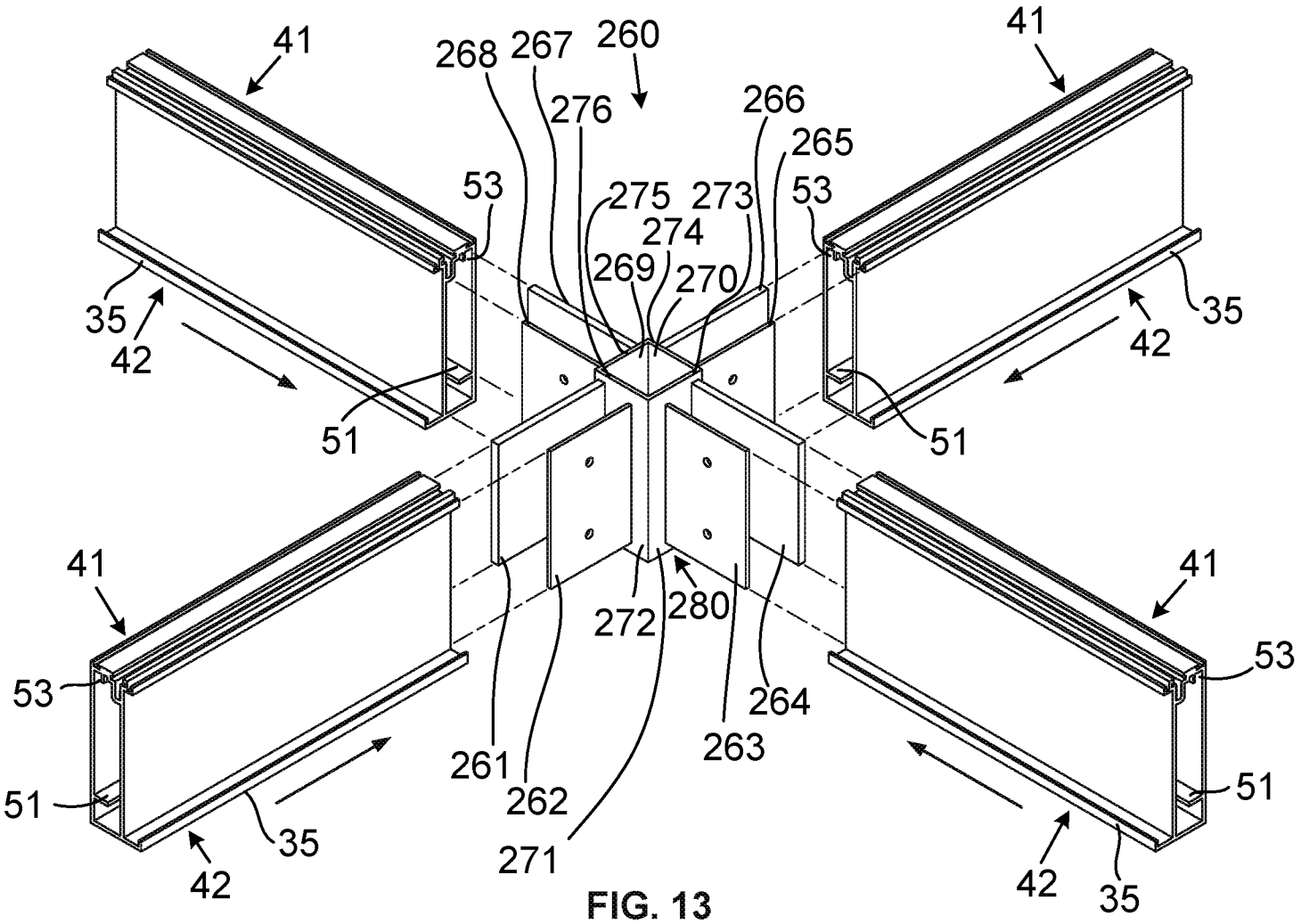

Next, FIG. 11, FIG. 12, and FIG. 13 depict additional example embodiments of deck components comprising a post sleeve and flanges on multiple side walls of the post sleeve. The dimensions of the post sleeves and flanges shown in FIG. 11, FIG. 12, and FIG. 13 can be the same as example dimensions discussed with respect to the deck component 10, although the post sleeves and/or the flanges of the deck components shown in FIG. 11, FIG. 12, and FIG. 13 can have different dimensions.

In particular, FIG. 11 shows a deck component 75 with flanges on two opposing side walls of four side walls of a post sleeve, FIG. 12 shows a deck component 125 with flanges on three of four side walls of a post sleeve, and FIG. 13 shows a deck component 260 with flanges on each of four side walls of a post sleeve. These embodiments differ from the deck component 10 that has flanges on two adjacent side walls only. The flanges on the deck components 75, 125, and 260 are configured for being positioned within box-frame-segments 35. The exterior surfaces of the side walls for the deck components 10, 75, 125 and 260 are flat so that a square-cut edge of the box-frame-segment 35 can be positioned flush against a side wall (i.e., in contact with each other).

As shown in FIG. 11, the deck component 75 has a post sleeve 90. The post sleeve 90 comprises side walls 80, 81, 82, and 83. The deck component 75 comprises flanges 76 and 77 that abut the side wall 82, and flanges 78 and 79 that abut the side wall 80. The post sleeve 90 is open above the side walls 80, 81, 82, and 83. The post sleeve 90 is open below the side walls 80, 81, 82, and 83. A post can enter the post sleeve 90 from above the side walls 80, 81, 82, and 83 and/or from below the side walls 80, 81, 82, and 83. Each side wall in the post sleeve 90 comprises an interior surface and an exterior surface. FIG. 11 shows an interior surface 86 of the side wall 80, an interior surface 87 of the side wall 82, an exterior surface 85 of the side wall 82, and an exterior surface 84 of the side wall 83.

As an example, the post sleeve 90 and the flanges 76, 77, 78, and 79 can be formed by extruding a metal billet through a die as a single extruded deck component comprising the post sleeve 90 and the flanges 76, 77, 78, and 79. The flanges 76, 77, 78, and 79 formed by extrusion can be milled to lower the top surfaces of the flanges 76, 77, 78, and 79 below the top surface of the post sleeve 90 and to raise the bottom surfaces of the flanges 76, 77, 78, and 79 above the bottom surface of the post sleeve 90. Milling of the 76, 77, 78, and 79 formed by extrusion allows the flanges 76 and 77 to be positioned within one box-frame-segment 35 shown in FIG. 11 and the flanges 78 and 79 to be positioned within another box-frame-segment 35 shown in FIG. 11.

As another example, the post sleeve 90 and the flanges 76, 77, 78, and 79 can be formed by casting a metal as a single cast deck component comprising the post sleeve 90 and the flanges 76, 77, 78, and 79. The mold used to form the single cast deck component can be formed to minimize or eliminate the need to mill the flanges 76, 77, 78, and 79 to fit within the box-frame-segment 35.

As yet another example, the post sleeve 90 can be formed by extruding or casting a metal and the flanges 76, 77, 78, and 79 can be formed by extruding, casting or rolling a metal. In accordance with this example, the deck component 75 can be formed by affixing the flanges 76, 77, 78, and 79 to the post sleeve 90. The flanges 76 and 77 can be affixed to the post sleeve 90 by welding the flanges 76 and 77 to the exterior surface 85 of the post sleeve 90. The flanges 78 and 79 can be affixed to the post sleeve 90 by welding the flanges 78 and 79 to the exterior surface of the side wall 80.

The flange 76 comprises attachment holes 91 and 92 for affixing the flange 76 to one of the box-frame-segments 35 shown in FIG. 11 using fasteners 50 (not shown). The flange 78 comprises attachment holes 93 and 94 for affixing the flange 78 to another of the box-frame-segments 35 shown in FIG. 11 using fasteners 50 (not shown).

Next, as shown in FIG. 12, the deck component 125 has a post sleeve 171. The post sleeve 171 comprises side walls 134, 135, 136, and 137. The deck component 125 comprises flanges 126 and 127 that abut the side wall 134, flanges 128 and 129 that abut the side wall 135, and flanges 130 and 131 that abut the side wall 136. The post sleeve 171 is open above the side walls 134, 135, 136, and 137. The post sleeve 171 is open below the side walls 134, 135, 136, and 137. A post can enter the post sleeve 171 from above the side walls 134, 135, 136, and 137 and/or from below the side walls 134, 135, 136, and 137. Each side wall in the post sleeve 171 comprises an interior surface and an exterior surface. FIG. 12 shows an interior surface 140 of the side wall 136, an interior surface 141 of the side wall 137, an exterior surface 138 of the side wall 134, and an exterior surface 139 of the side wall 135.

As an example, the post sleeve 171 and the flanges 126, 127, 128, 129, 130, and 131 can be formed by extruding a metal billet through a die as a single extruded deck component comprising the post sleeve 171 and the flanges 126, 127, 128, 129, 130, and 131. The flanges 126, 127, 128, 129, 130, and 131 formed by extrusion can be milled to lower the top surfaces of the flanges 126, 127, 128, 129, 130, and 131 below the top surface of the post sleeve 171 and to raise the bottom surfaces of the flanges 126, 127, 128, 129, 130, and 131 above the bottom surface of the post sleeve 171. Milling of the 126, 127, 128, 129, 130, and 131 formed by extrusion allows the flanges 126 and 127 to be positioned within one box-frame-segment 35 shown in FIG. 12, the flanges 128 and 129 to be positioned within another box-frame-segment 35 shown in FIG. 12, and the flanges 130 and 131 to be positioned within yet another box-frame-segment 35 shown in FIG. 12.

As another example, the post sleeve 171 and the flanges 126, 127, 128, 129, 130, and 131 can be formed by casting a metal as a single cast deck component comprising the post sleeve 171 and the flanges 126, 127, 128, 129, 130, and 131. The mold used to form the single cast deck component can be formed to minimize or eliminate the need to mill the flanges 126, 127, 128, 129, 130, and 131 to fit within the box-frame-segments 35.

As yet another example, the post sleeve 171 can be formed by extruding or casting a metal and the flanges 126, 127, 128, 129, 130, and 131 can be formed by extruding, casting or rolling a metal. In accordance with this example, the deck component 125 can be formed by affixing the flanges 126, 127, 128, 129, 130, and 131 to the post sleeve 171. The flanges 126 and 127 can be affixed to the post sleeve 171 by welding the flanges 126 and 127 to the exterior surface 138 of the post sleeve 171. The flanges 128 and 129 can be affixed to the post sleeve 171 by welding the flanges 128 and 129 to the exterior surface of the side wall 135. The flanges 130 and 131 can be affixed to the post sleeve 171 by welding the flanges 130 and 131 to the exterior surface of the side wall 136.

The flange 127, the flange 128, and the flange 130 comprise attachment holes for affixing the flanges 127, 128, and 130 to a respective box-frame-segment 35 shown in FIG. 12 using fasteners 50 (not shown).

Next, as shown in FIG. 13, the deck component 260 has a post sleeve 280. The post sleeve 280 comprises side walls 273, 274, 275, and 276. The deck component 260 comprises flanges 261 and 262 that abut the side wall 276, flanges 263 and 264 that abut the side wall 273, flanges 265 and 266 that abut the side wall 273, and the flanges 267 and 268 that abut the side wall 275. The post sleeve 280 is open above the side walls 273, 274, 275, and 276. The post sleeve 280 is open below the side walls 273, 274, 275, and 276. A post can enter the post sleeve 280 from above the side walls 273, 274, 275, and 276 and/or from below the side walls 273, 274, 275, and 276. Each side wall in the post sleeve 280 comprises an interior surface and an exterior surface. FIG. 13 shows an interior surface 270 of the side wall 274, an interior surface 269 of the side wall 275, an exterior surface 272 of the side wall 276, and an exterior surface 271 of the side wall 273.

As an example, the post sleeve 280 and the flanges 261, 262, 263, 264, 265, 266, 267, and 268 can be formed by extruding a metal billet through a die as a single extruded deck component comprising the post sleeve 280 and the flanges 261, 262, 263, 264, 265, 266, 267, and 268. The flanges 261, 262, 263, 264, 265, 266, 267, and 268 formed by extrusion can be milled to lower the top surfaces of the flanges 261, 262, 263, 264, 265, 266, 267, and 268 below the top surface of the post sleeve 280 and to raise the bottom surfaces of the flanges 261, 262, 263, 264, 265, 266, 267, and 268 above the bottom surface of the post sleeve 280. Milling of the 261, 262, 263, 264, 265, 266, 267, and 268 formed by extrusion allows the flanges 261 and 262 to be positioned within one box-frame-segment 35 shown in FIG. 13, the flanges 263 and 264 to be positioned within another box-frame-segment 35 shown in FIG. 13, the flanges 265 and 266 to be positioned within yet another box-frame-segment 35 shown in FIG. 13, and the flanges 267 and 268 to be positioned within still yet another box-frame-segment 35 shown in FIG. 13.

As another example, the post sleeve 280 and the flanges 261, 262, 263, 264, 265, 266, 267, and 268 can be formed by casting a metal as a single cast deck component comprising the post sleeve 280 and the flanges 261, 262, 263, 264, 265, 266, 267, and 268. The mold used to form the single cast deck component can be formed to minimize or eliminate the need to mill the flanges 261, 262, 263, 264, 265, 266, 267, and 268 to fit within the box-frame-segments 35.

As yet another example, the post sleeve 280 can be formed by extruding or casting a metal and the flanges 261, 262, 263, 264, 265, 266, 267, and 268 can be formed by extruding, casting or rolling a metal. In accordance with this example, the deck component 260 can be formed by affixing the flanges 261, 262, 263, 264, 265, 266, 267, and 268 to the post sleeve 280. The flanges 261 and 262 can be affixed to the post sleeve 280 by welding the flanges 261 and 262 to the exterior surface 272 of the post sleeve 280. The flanges 263 and 264 can be affixed to the post sleeve 280 by welding the flanges 263 and 264 to the exterior surface 280. The flanges 265 and 266 can be affixed to the post sleeve 280 by welding the flanges 265 and 266 to the exterior surface of the side wall 274. The flanges 267 and 268 can be affixed to the post sleeve 280 by welding the flanges 267 and 268 to the exterior surface of the side wall 275.

The flange 262, the flange 263, the flange 265, and the flange 267 comprise attachment holes for affixing the flanges 262, 263, 265, and 267 to a respective box-frame-segment 35 shown in FIG. 13 using fasteners 50 (not shown).

Figure 14:
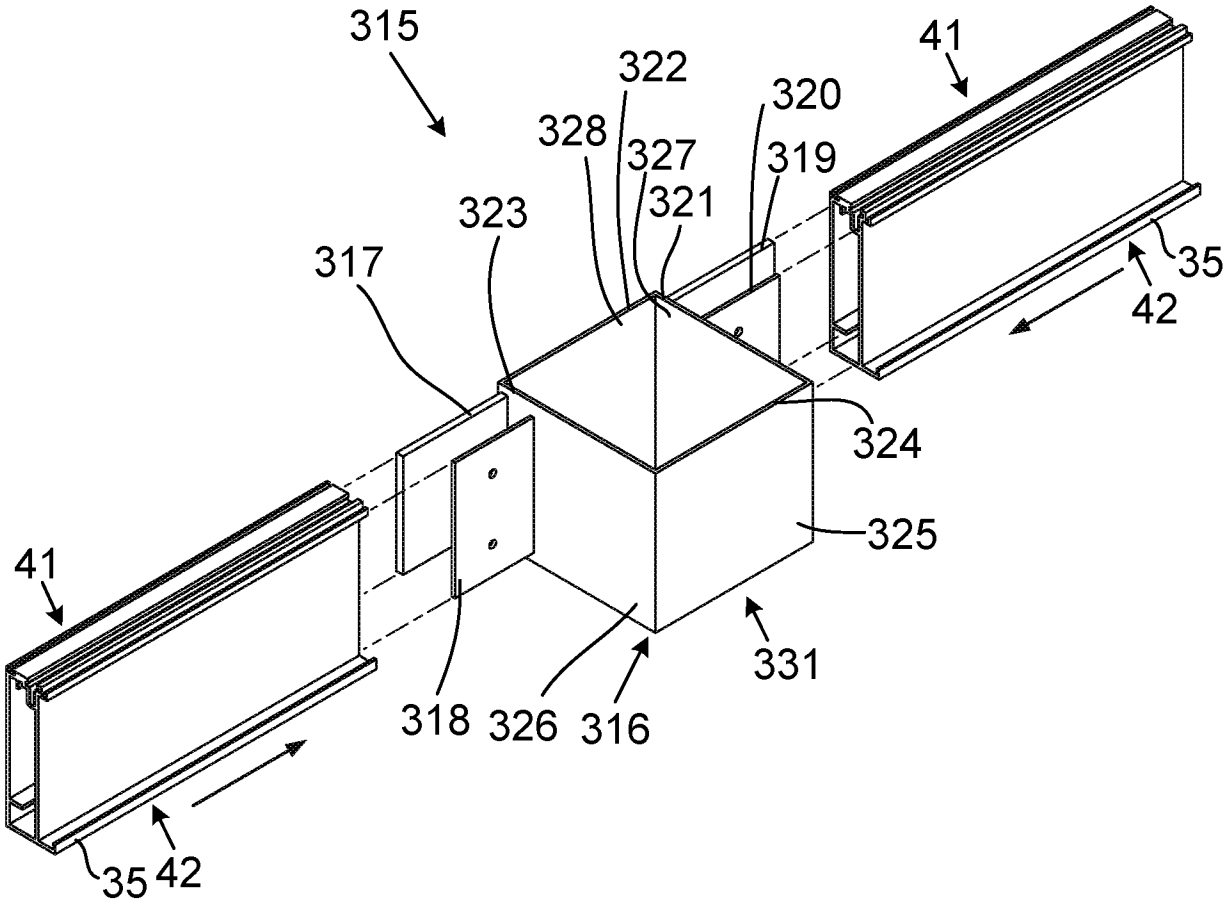
Figure 15:
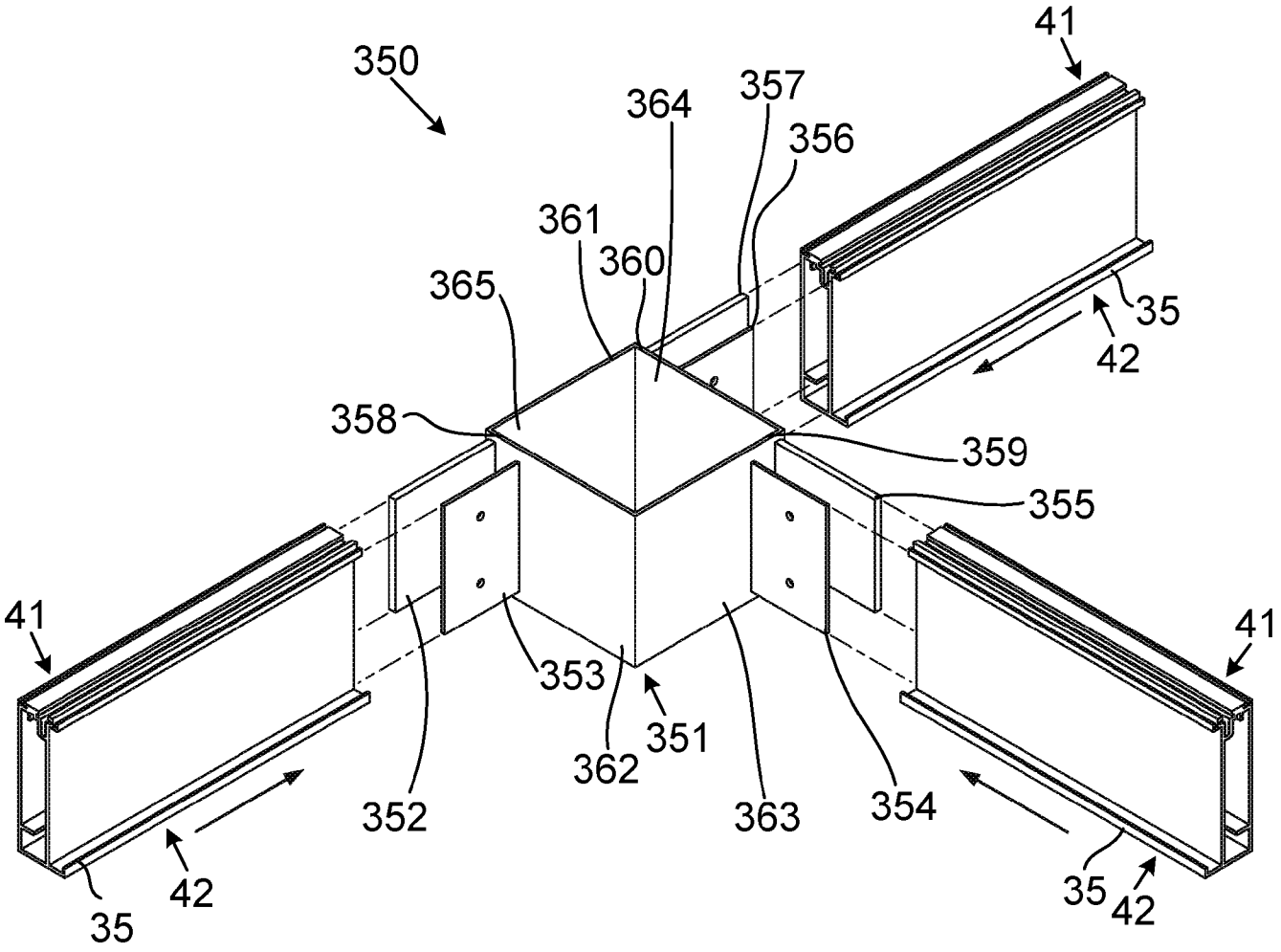
Figure 16:
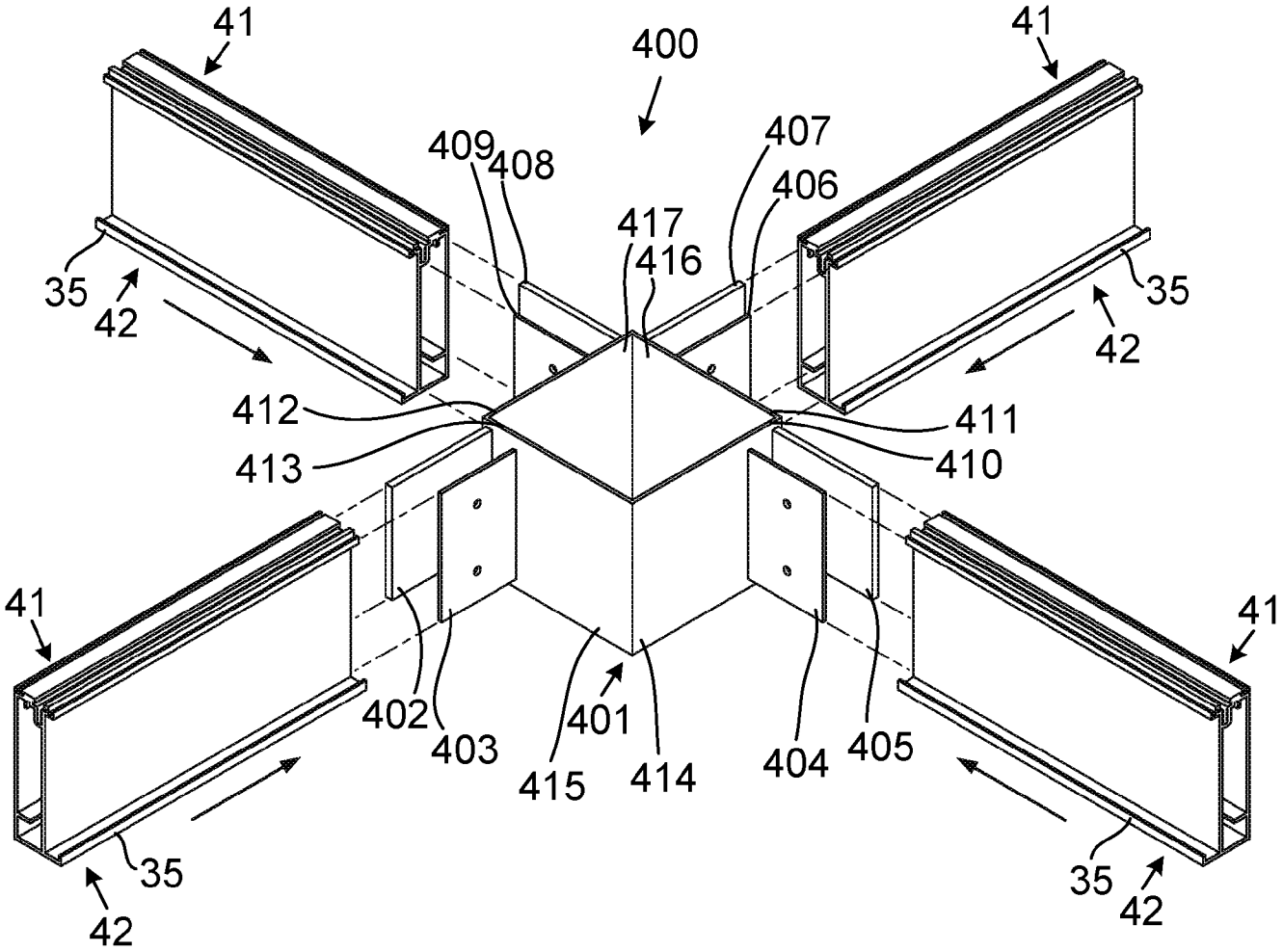

Next, FIG. 14, FIG. 15, and FIG. 16 depict additional example embodiments of deck components comprising a post sleeve and flanges on multiple side walls of the post sleeve. The dimensions of the post sleeves and flanges shown in FIG. 14, FIG. 15, and FIG. 16 can be the same as example dimensions discussed with respect to the deck component 110, although the post sleeves and/or the flanges of the deck components shown in FIG. 14, FIG. 15, and FIG. 16 can have different dimensions.

In particular, FIG. 14 shows a deck component 315 with flanges on two opposing side walls of four side walls of a post sleeve, FIG. 15 shows a deck component 350 with flanges on three of four side walls of a post sleeve, and FIG. 16 shows a deck component 400 with flanges on each of four side walls of a post sleeve. These embodiments differ from the deck component 110 that has flanges on two adjacent side walls only. The flanges on the deck components 315, 350, and 400 are configured for being positioned within box-frame-segments 35. The exterior surfaces of the side walls for the deck components 110, 315, 300, and 400 are flat so that a square-cut edge of the box-frame-segment 35 can be positioned flush against a side wall (i.e., in contact with each other).

As shown in FIG. 14, the deck component 315 has a post sleeve 331. The post sleeve 331 comprises side walls 321, 322, 323, and 324. The deck component 315 comprises flanges 317 and 318 that abut the side wall 323, and flanges 319 and 320 that abut the side wall 321. The post sleeve 331 is open above the side walls 321, 322, 323, and 324. The post sleeve 331 is open below the side walls 321, 322, 323, and 324. A post can enter the post sleeve 331 from above the side walls 321, 322, 323, and 324 and/or from below the side walls 321, 322, 323, and 324. Each side wall in the post sleeve 331 comprises an interior surface and an exterior surface. FIG. 14 shows an interior surface 327 of the side wall 321, an interior surface 328 of the side wall 322, an exterior surface 326 of the side wall 323, and an exterior surface 325 of the side wall 324.

As an example, the post sleeve 331 and the flanges 317, 318, 319, and 320 can be formed by extruding a metal billet through a die as a single extruded deck component comprising the post sleeve 331 and the flanges 317, 318, 319, and 320. The flanges 317, 318, 319, and 320 formed by extrusion can be milled to lower the top surfaces of the flanges 317, 318, 319, and 320 below the top surface of the post sleeve 331 and to raise the bottom surfaces of the flanges 317, 318, 319, and 320 above the bottom surface of the post sleeve 331. Milling of the 317, 318, 319, and 320 formed by extrusion allows the flanges 317 and 318 to be positioned within one box-frame-segment 35 shown in FIG. 14 and the flanges 319 and 320 to be positioned within another box-frame-segment 35 shown in FIG. 14.

As another example, the post sleeve 331 and the flanges 317, 318, 319, and 320 can be formed by casting a metal as a single cast deck component comprising the post sleeve 331 and the flanges 317, 318, 319, and 320. The mold used to form the single cast deck component can be formed to minimize or eliminate the need to mill the flanges 317, 318, 319, and 320 to fit within the box-frame-segment 35.

As yet another example, the post sleeve 331 can be formed by extruding or casting a metal and the flanges 317, 318, 319, and 320 can be formed by extruding, casting or rolling a metal. In accordance with this example, the deck component 315 can be formed by affixing the flanges 317, 318, 319, and 320 to the post sleeve 331. The flanges 317 and 318 can be affixed to the post sleeve 331 by welding the flanges 317 and 318 to the exterior surface 326 of the post sleeve 331. The flanges 319 and 320 can be affixed to the post sleeve 331 by welding the flanges 319 and 320 to the exterior surface of the side wall 321.

The flange 318 and the flange 320 comprise attachment holes for affixing the flanges 318 and 320 to a respective box-frame-segment 35 shown in FIG. 14 using fasteners 50 (not shown).

Next, as shown in FIG. 15, the deck component 350 has a post sleeve 351. The post sleeve 351 comprises side walls 358, 359, 360, and 361. The deck component 350 comprises flanges 352 and 353 that abut the side wall 358, flanges 354 and 355 that abut the side wall 359, and flanges 356 and 357 that abut the side wall 360. The post sleeve 351 is open above the side walls 358, 359, 360, and 361. The post sleeve 351 is open below the side walls 358, 359, 360, and 361. A post can enter the post sleeve 351 from above the side walls 358, 359, 360, and 361 and/or from below the side walls 358, 359, 360, and 361. Each side wall in the post sleeve 351 comprises an interior surface and an exterior surface. FIG. 15 shows an interior surface 364 of the side wall 360, an interior surface 365 of the side wall 361, an exterior surface 362 of the side wall 358, and an exterior surface 363 of the side wall 359.

As an example, the post sleeve 351 and the flanges 352, 353, 354, 355, 356, and 357 can be formed by extruding a metal billet through a die as a single extruded deck component comprising the post sleeve 351 and the flanges 352, 353, 354, 355, 356, and 357. The flanges 352, 353, 354, 355, 356, and 357 formed by extrusion can be milled to lower the top surfaces of the flanges 352, 353, 354, 355, 356, and 357 below the top surface of the post sleeve 351 and to raise the bottom surfaces of the flanges 352, 353, 354, 355, 356, and 357 above the bottom surface of the post sleeve 351. Milling of the 352, 353, 354, 355, 356, and 357 formed by extrusion allows the flanges 352 and 353 to be positioned within one box-frame-segment 35 shown in FIG. 15, the flanges 354 and 355 to be positioned within another box-frame-segment 35 shown in FIG. 15, and the flanges 356 and 357 to be positioned within yet another box-frame-segment 35 shown in FIG. 15.

As another example, the post sleeve 351 and the flanges 352, 353, 354, 355, 356, and 357 can be formed by casting a metal as a single cast deck component comprising the post sleeve 351 and the flanges 352, 353, 354, 355, 356, and 357. The mold used to form the single cast deck component can be formed to minimize or eliminate the need to mill the flanges 352, 353, 354, 355, 356, and 357 to fit within the box-frame-segments 35.

As yet another example, the post sleeve 351 can be formed by extruding or casting a metal and the flanges 352, 353, 354, 355, 356, and 357 can be formed by extruding, casting or rolling a metal. In accordance with this example, the deck component 350 can be formed by affixing the flanges 352, 353, 354, 355, 356, and 357 to the post sleeve 351. The 352 and 353 can be affixed to the post sleeve 351 by welding the flanges 352 and 353 to the exterior surface 362 of the post sleeve 351. The flanges 354 and 355 can be affixed to the post sleeve 351 by welding the flanges 354 and 355 to the exterior surface 363. The flanges 356 and 357 can be affixed to the post sleeve 351 by welding the flanges 356 and 357 to the exterior surface of the side wall 360.

The flange 353, the flange 354, and the flange 356 comprise attachment holes for affixing the flanges 353, 354, and 356 to a respective box-frame-segment 35 shown in FIG. 15 using fasteners 50 (not shown).

Next, as shown in FIG. 16, the deck component 400 has a post sleeve 401. The post sleeve 401 comprises side walls 410, 411, 412, and 413. The deck component 400 comprises flanges 402 and 403 that abut the side wall 413, flanges 404 and 405 that abut the side wall 410, flanges 406 and 407 that abut the side wall 411, and the flanges 408 and 409 that abut the side wall 412. The post sleeve 401 is open above the side walls 410, 411, 412, and 413. The post sleeve 401 is open below the side walls 410, 411, 412, and 413. A post can enter the post sleeve 401 from above the side walls 410, 411, 412, and 413 and/or from below the side walls 410, 411, 412, and 413. Each side wall in the post sleeve 401 comprises an interior surface and an exterior surface. FIG. 16 shows an interior surface 416 of the side wall 411, an interior surface 417 of the side wall 412, an exterior surface 415 of the side wall 413, and an exterior surface 414 of the side wall 410.

As an example, the post sleeve 401 and the flanges 402, 403, 404, 405, 406, 407, 408, and 409 can be formed by extruding a metal billet through a die as a single extruded deck component comprising the post sleeve 401 and the flanges 402, 403, 404, 405, 406, 407, 408, and 409. The flanges 402, 403, 404, 405, 406, 407, 408, and 409 formed by extrusion can be milled to lower the top surfaces of the flanges 402, 403, 404, 405, 406, 407, 408, and 409 below the top surface of the post sleeve 401 and to raise the bottom surfaces of the flanges 402, 403, 404, 405, 406, 407, 408, and 409 above the bottom surface of the post sleeve 401. Milling of the 402, 403, 404, 405, 406, 407, 408, and 409 formed by extrusion allows the flanges 402 and 403 to be positioned within one box-frame-segment 35 shown in FIG. 16, the flanges 404 and 405 to be positioned within another box-frame-segment 35 shown in FIG. 16, the flanges 406 and 407 to be positioned within yet another box-frame-segment 35 shown in FIG. 16, and the flanges 408 and 409 to be positioned within still yet another box-frame-segment 35 shown in FIG. 16.

As another example, the post sleeve 401 and the flanges 402, 403, 404, 405, 406, 407, 408, and 409 can be formed by casting a metal as a single cast deck component comprising the post sleeve 401 and the flanges 402, 403, 404, 405, 406, 407, 408, and 409. The mold used to form the single cast deck component can be formed to minimize or eliminate the need to mill the flanges 402, 403, 404, 405, 406, 407, 408, and 409 to fit within the box-frame-segments 35.

As yet another example, the post sleeve 401 can be formed by extruding or casting a metal and the flanges 402, 403, 404, 405, 406, 407, 408, and 409 can be formed by extruding, casting or rolling a metal. In accordance with this example, the deck component 400 can be formed by affixing the flanges 402, 403, 404, 405, 406, 407, 408, and 409 to the post sleeve 401. The flanges 402 and 403 can be affixed to the post sleeve 401 by welding the flanges 402 and 403 to the exterior surface 415 of the post sleeve 401. The flanges 404 and 405 can be affixed to the post sleeve 401 by welding the flanges 404 and 405 to the exterior surface 414. The flanges 406 and 407 can be affixed to the post sleeve 401 by welding the flanges 406 and 407 to the exterior surface of the side wall 411. The flanges 408 and 409 can be affixed to the post sleeve 401 by welding the flanges 408 and 409 to the exterior surface of the side wall 412.

The flange 403, the flange 404, the flange 406, and the flange 409 comprise attachment holes for affixing the flanges 403, 404, 406, and 409 to a respective box-frame-segment 35 shown in FIG. 16 using fasteners 50 (not shown).

Figure 17:
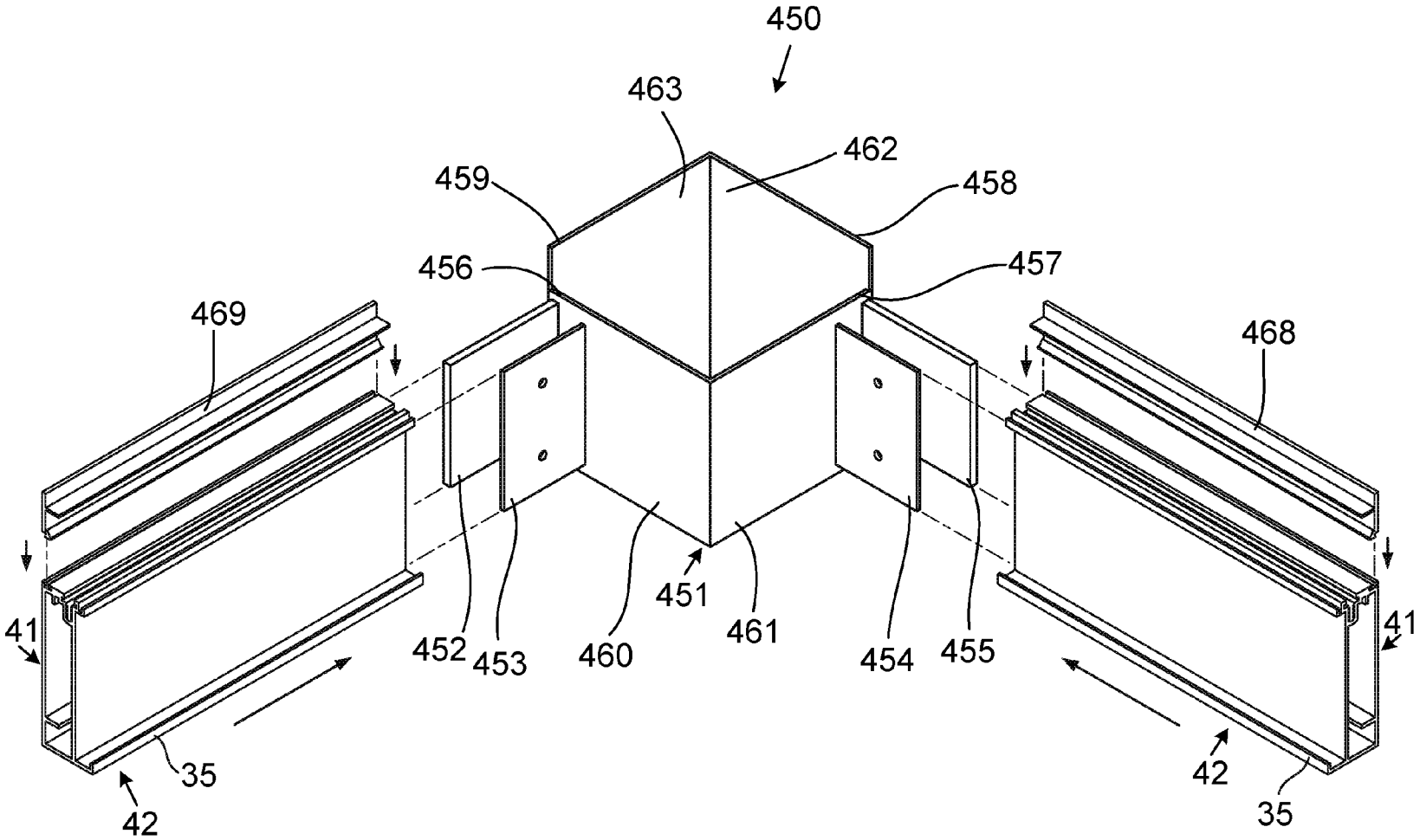

Next, FIG. 17 is an isometric view of a deck component 450, two box-frame-segments 35, and a perimeter-trim-piece 468 and a perimeter-trim-piece 469 that can be attached to two box-frame-segments 35.

The deck component 450 comprises a post sleeve 451. The post sleeve 451 comprises side walls 456, 457, 458, and 459. The deck component 450 comprises flanges 452 and 453 that abut the side wall 456, and flanges 454 and 455 that abut the side wall 457. The post sleeve 451 is open above the side walls 456, 457, 458, and 459. The post sleeve 451 is open below the side walls 456, 457, 458, and 459. A post can enter the post sleeve 451 from above the side walls 456, 457, 458, and 459 and/or from below the side walls 456, 457, 458, and 459. Each side wall in the post sleeve 451 comprises an interior surface and an exterior surface. In particular, the side wall 458 has an interior surface 462 and an exterior surface (not shown), the side wall 459 has an interior surface 463 and an exterior surface (not shown), the side wall 460 has an interior surface (not shown) and an exterior surface 460, and the side wall 457 has an interior surface (not shown) and an exterior surface 461.

As an example, the post sleeve 451 and the flanges 452, 453, 454, and 455 can be formed by extruding a metal billet through a die as a single extruded deck component comprising the post sleeve 451 and the flanges 452, 453, 454, and 455. The flanges 452, 453, 454, and 455 formed by extrusion can be milled to lower the top surfaces of the flanges 452, 453, 454, and 455 below the top surface of the side walls 456 and 457 and to raise the bottom surfaces of the flanges 452, 453, 454, and 455 above the bottom surface of the post sleeve 451. Milling of the flanges 452, 453, 454, and 455 formed by extrusion allows the flanges 452 and 453 to be positioned within one box-frame-segment 35 shown in FIG. 17 and the flanges 454 and 455 to be positioned within another box-frame-segment 35 shown in FIG. 17.

The side walls 456 and 457 can be milled so that a distance from the bottoms of the side walls 456 and 457 to the tops of the side walls 456 and 457 is shorter than a distance from the bottom of the side walls 458 and 459 to a top of the side walls 458 and 459. The difference in those two distances can be equal to a height of a deck board to be installed upon a box-frame perimeter using the deck component 450. As an example, the deck board height can be 2.54 cm (i.e., 1 inch), 3.175 cm (i.e., 1.25 inches) or some other dimension of deck boards. The deck boards can be made of wood, a composite material or some other material.

As another example, the post sleeve 451 and the flanges 452, 453, 454, and 455 can be formed by casting a metal as a single cast deck component comprising the post sleeve 451 and the flanges 452, 453, 454, and 455. The mold used to form the single cast deck component can be formed to minimize or eliminate the need to mill the flanges 452, 453, 454, and 455 to fit within the box-frame-segment 35.

As yet another example, the post sleeve 451 can be formed by extruding or casting a metal and the flanges 452, 453, 454, and 455 can be formed by extruding, casting or rolling a metal. In accordance with this example, the deck component 450 can be formed by affixing the flanges 452, 453, 454, and 455 to the post sleeve 451. The flanges 452 and 453 can be affixed to the post sleeve 451 by welding the flanges 452 and 453 to the exterior surface 460. The flanges 454 and 455 can be affixed to the post sleeve 451 by welding the flanges 454 and 455 to the exterior surface 461.

The welds on the flanges 452, 453, 454, and 455 can stop short of the tops and bottoms of the flanges 452, 453, 454, and 455 so that the welds do not interfere with positioning the flanges 452, 453, 454, and 455 within the box-frame-segment 35. For example, the welds for attaching the flanges 452 and 453 may stop short of the tops of flanges 452 and 453 so that the welds do not interfere with the vertical element 511 of the box-frame-segment 35.

The deck component 450 can be manufactured with various dimensions. For example, the dimensions of the deck component 450 can be the same as the dimensions discussed with respect to the deck component 110 except that the height of the side walls 458 and 459 are greater than the height of the side walls 456 and 457. As another example, the dimensions of the deck component 450 can be the same as the dimensions discussed with respect to the deck component 10 except that the height of the side walls 458 and 459 are greater than the height of the side walls 456 and 457. As discussed the different in the height of the side walls 458 and 459 with respect to the height of the side walls 456 and 457 can be equal to the height of a deck board to be installed onto a deck using the deck component 450.

The flanges 453 and 454 comprise attachment holes. The attachment holes can comprise through-holes. The flanges 453 and 454 can comprise a different number of attachment holes. The flanges 452 and 455 may not comprise any attachment holes because it may preferable to not mill attachment holes within the exterior sides 41 of the box-frame-segments 35 for aesthetic reasons. In an alternative arrangement, attachment holes could be milled into the flanges 452 and 455 for placement of fasteners through attachment holes milled into the exterior sides 41.

After the flanges 454 and 455 are positioned within the box-frame-segment 35, fasteners 50 (not shown in FIG. 17) can affix the deck component 450 to the box-frame-segments 35 in which the flanges 454 and 455 have been installed. The attachment holes in the flange 454 can be used as guides to drill corresponding attachment holes within the box-frame-segment 35. The fasteners 50 that affix the deck component 450 to the box-frame-segment 35 can comprise self-tapping screws or another type of fastener. The attachment holes in the box-frame-segment 35 for receiving fasteners placed through attachment holes in the flange 454 could be drilled before the flanges 454 and 455 are positioned within the box-frame-segment 35.

Similarly, after the flanges 452 and 453 are positioned within the box-frame-segment 35, fasteners 50 (not shown in FIG. 17) can affix the deck component 450 to the box-frame-segment 35 in which the flanges 452 and 453 have been installed. The attachment holes within the flanges 453 can be used as guides to drill corresponding attachment holes within the box-frame-segment 35. The fasteners 50 that affix the deck component 450 to the box-frame-segment 35 can comprise self-tapping screws or another type of fastener. The attachment holes in the box-frame-segment 35 for receiving fasteners placed through attachment holes within the flange 453 could be drilled before the flanges 452 and 453 are positioned within the box-frame-segment 35.

One or more of the deck components 110 in the box-frame-perimeter 225 could be replaced by a deck component 450.

Figure 18:
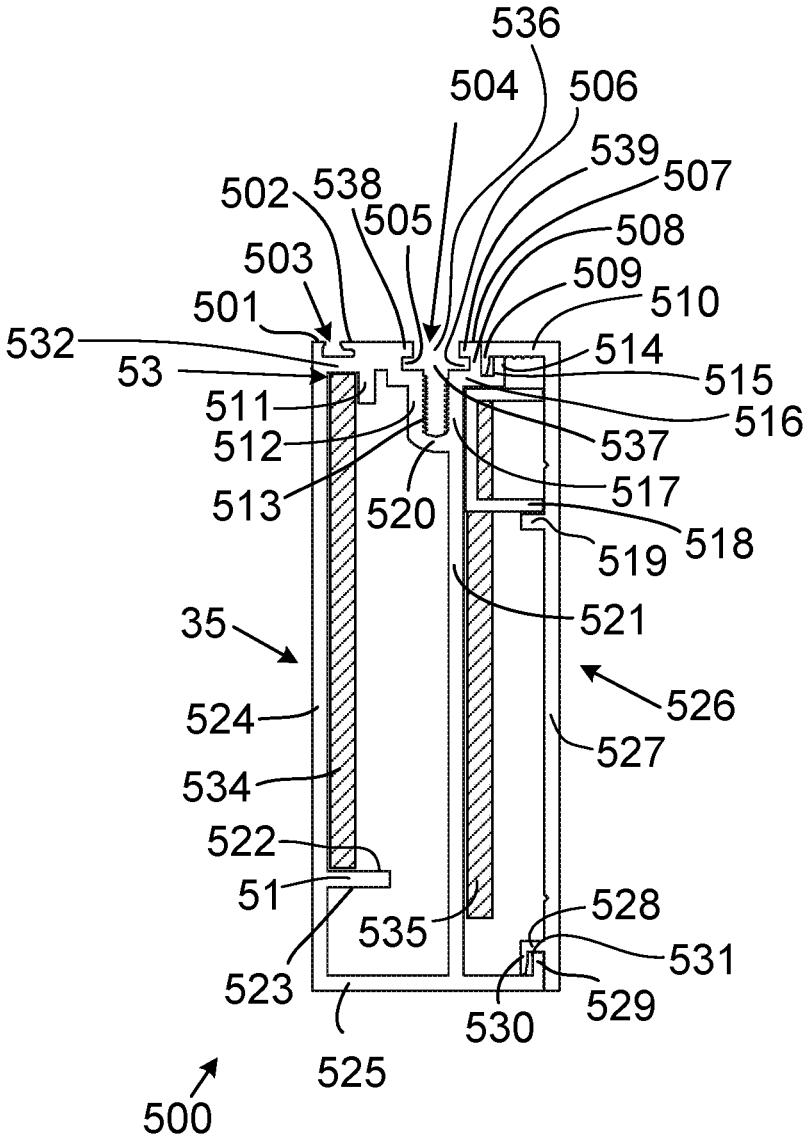
FIG. 18 shows a sectional view of a box-frame-segment with a box-frame segment attached and flanges positioned within the box-frame-segment.

Next, FIG. 18 shows a section view of a box-frame-segment assembly 500 that can form part of a deck system, such as a box-frame within a deck system. The box-frame-segment assembly 500 comprises a box-frame-segment 35, a box-frame-segment attachment 526, and an uplift clip 518. The section view of FIG. 18 shows a flange 534 and a flange 535 that can be positioned within the box-frame-segment assembly 500.

The box-frame-segment 35, the box-frame-segment attachment 526, and the uplift clip 518 can comprise an extruded or cast metal. Each of those extrusions or castings can be made with uniform features over an entire extrusion or casting prior to performance of any milling, drilling or other operation to the extrusion or casting. The following description of the box-frame-segment 35 and the box-frame-segment attachment 526 refers to various elements, splines, fins, shelves, and tabs. Each of those elements, splines, fins, shelves, and tabs comprises a portion of the extruded or cast metal.

The box-frame-segment 35 comprises a vertical element 524, a base horizontal element 525, a top horizontal element 501, a top horizontal element 502, a top horizontal element 507, a locking-tab 514, a deck-clip slot 504, and deck screw splines 513. The top horizontal element 502 comprises a tab 538 positioned above a recessed portion 505 of the deck-clip slot 504. The top horizontal element 507 comprises a tab 539 positioned above a recessed portion 506 of the deck-clip slot 504.

The deck screw splines 513 are accessible through the deck-clip slot 504 between the top horizontal element 502 and the top horizontal element 507. The deck-clip slot 504 comprises a narrow slot 536 extending from the top horizontal element 502 to the top horizontal element 507. The deck-clip slot 504 comprises a wide slot 537 below the narrow slot 536 and above the deck screw splines 513. The wide slot 537 comprises the recessed area 505 below the tab 538 and the recessed area 506 below the tab 539. The wide slot 507 allows for positioning a base of a deck clip (or the base and a lower portion of a vertical element of the deck-clip) and the narrow slot 536 allows for positioning a narrow portion of the deck clip.

The recessed areas 505 and 506 allow a deck-clip installed into the deck-clip slot 504 to be slid axially within the deck-clip slot 504. The tabs 538 and 539 correspond to notches of a notched area of a deck-clip. Portions of the tabs 538 and 539 (at a location where the deck-clip is positioned) can extend within notches of the notched area of a deck-clip. The tabs 538 and 539 prevent an installed deck-clip from being lifted upward out of the deck-clip slot 504 as portions of the base of the deck-clip are positioned below the tabs 538 and 539.

The box-frame-segment 35 comprises a vertical element 512, a vertical element 517, and a horizontal element 520. The horizontal element 520 extends between lower portions of the vertical element 512 and the vertical element 513. The deck screw splines 513 are formed into the vertical element 512 and the vertical element 513.

The box-frame-segment comprises a locking-tap slot 515 adjacent to the top horizontal element 507. The locking-tab slot 515 is adapted to accept a locking-tab 509 on the box-frame-segment attachment 526. The box-frame-segment 35 comprises a locking-tab 529 at an end of the horizontal element 525 adapted to be positioned within a locking-tab slot 531 on the box-frame-segment attachment 526.

The box-frame-segment comprises a perimeter-trim-piece slot 503 positioned between the top horizontal element 501 and the top horizontal element 502. The perimeter-trim-piece slot 503 comprises a vertical slot extending from between the top horizontal elements 501 and 502 and a horizontal slot extending from the vertical slot to beneath the top horizontal element 502. As an example, the vertical slot can be 0.125 inches and the horizontal slot can be 0.25 inches. A perimeter-trim-piece, such as the perimeter-trim-piece 468 shown in FIG. 17, can be inserted into the perimeter-trim-piece slot 503 to cover edges of deck boards positioned upon a deck system including the box-frame-segment assembly 500.

The box-frame-segment 35 comprises a reinforcement shelf 51 to support the flange 534 within the box-frame-segment assembly 500. As an example, the flange 534 can comprise: (i) the flange 16 or the flange 18 of the deck component 10, (ii) the flange 116 or the flange 118 of the deck component 110, (iii) the flange 77 or the flange 79 of the deck component 75, (iv) the flange 126, the flange 129, or the flange 131 of the deck component 125, (v) the flange 261, the flange 264, the flange 266 or the flange 267 of the deck component 260, (vi) the flange 317 or the flange 319 of the deck component 315, (vii) the flange 352, the flange 355, or the flange 357 of the deck component 350, (viii) the flange 402, the flange 405, the flange 407, or the flange 408 of the deck component 400, or (ix) the flange 452 or the flange 455 of the deck component 450.

An upper portion of the flange 534 can be positioned within a flange guide 53 formed, in part, by and between the vertical element 524 and a vertical element 511, and below a horizontal element 532 that is below the perimeter-trim-piece slot 503 and that extends from the vertical element 524 to the recessed portion 505. The flange 534 extends from an upper surface 522 of the reinforcement shelf 51 to a position within the flange guide 53. The reinforcement shelf 51 comprises a lower surface 523.

The box-frame-segment 35 comprises a horizontal element 516 that extends from the vertical element 517 to the locking-tab 514. The box-frame-segment 35 comprises a vertical element 508 that extends from the top horizontal element 507 to the horizontal element 516.

The box-frame-segment 35 comprises a reinforcement fin 521. The reinforcement fin 521 extends from the vertical element 517 down to the horizontal element 525. As an example, the reinforcement fin 521 can have a thickness of 0.125 inches and a length of 4.125 inches.

The box-frame-segment attachment 526 comprises a vertical element 527, a top horizontal element 510 extending from the vertical element 527 to the locking-tab 509. The box-frame-segment attachment 526 comprises a horizontal element 528 extending away from the vertical element 527 and the locking-tab 530 extending away from the horizontal element 528 so as to form the locking-tab slot 531. The box-frame-segment attachment 526 comprises an uplift clip shelf 519 for supporting the uplift clip 518. Positioning the uplift clip 518 within the box-frame-segment assembly 500 can prevent removal of the box-frame-segment attachment 526 from the box-frame-segment 35. Removing the uplift clip 518 from the box-frame-segment assembly 500 allows for the box-frame-segment attachment 526 to be removed from the box-frame-segment 35.

The flange 535 can be positioned within the box-frame-segment assembly 500. The flange 535 can be affixed to the reinforcement fin 521 using fasteners 50. As an example, the flange 535 can comprise: (i) the flange 17 or the flange 19 of the deck component 10, (ii) the flange 117 or the flange 119 of the deck component 110, (iii) the flange 76 or the flange 78 of the deck component 75, (iv) the flange 127, the flange 128, or the flange 130 of the deck component 125, (v) the flange 262, the flange 263, the flange 265 or the flange 268 of the deck component 260, (vi) the flange 318 or the flange 320 of the deck component 315, (vii) the flange 353, the flange 354, or the flange 356 of the deck component 350, (viii) the flange 403, the flange 404, the flange 406, or the flange 408 of the deck component 400, or (ix) the flange 453 or the flange 454 of the deck component 450.

III. Conclusion

It should be understood that the arrangements described herein and/or shown in the drawings are for purposes of example only. As such, those skilled in the art will appreciate that other arrangements and elements can be used instead, and some elements can be omitted altogether according to the desired results.

While various aspects and embodiments are described herein, other aspects and embodiments will be apparent to those skilled in the art. The various aspects and embodiments disclosed herein are for purposes of illustration and are not intended to be limiting, with the true scope being indicated by the claims, along with the full scope of equivalents to which such claims are entitled. It is also to be understood that the terminology used herein for the purpose of describing particular embodiments only, and is not intended to be limiting.

In this description, the articles "a," "an," and "the" are used to introduce elements of the example embodiments. The intent of using those articles is that there is one or more of the introduced elements.

In this description, the intent of using the term "and/or" within a list of at least two elements and the intent of using the terms "at least one of" and "one or more of" immediately preceding a list of at least two elements is to cover each embodiment including a listed component independently and each embodiment comprising a combination of the listed components. For example, an embodiment described as comprising "A, B, and/or C," or "at least one of A, B, and C," or "one or more of A, B, and C" is intended to cover each of the following possible embodiments: (i) an embodiment comprising A, but not B and not C, (ii) an embodiment comprising B, but not A and not C, (iii) an embodiment comprising C, but not A and not B, (iv) an embodiment comprising A and B, but not C, (v) an embodiment comprising A and C, but not B, (v) an embodiment comprising B and C, but not A, and (vi) an embodiment comprising A, B, and C. For the embodiments comprising component A, the embodiments can comprise one A or multiple A. For the embodiments comprising component B, the embodiments can comprise one B or multiple B. For the embodiments comprising component C, the embodiments can comprise one C or multiple C. The use of ordinal numbers such as "first," "second," "third" and so on is to distinguish respective elements rather than to denote a particular order of those elements unless the context of using those terms explicitly indicates otherwise.

I claim:

1. A deck component comprising:

a post sleeve comprising a first side wall, a second side wall, a third side wall, and a fourth side wall, wherein the first side wall abuts the second side wall and the third side wall, wherein the second side wall abuts the first side wall and the fourth side wall, wherein the third side wall abuts the first side wall and the fourth side wall, wherein the fourth side wall abuts the second side wall and the third side wall, and wherein a top of the post sleeve and a bottom of the post sleeve are open for accepting a post into the post sleeve;

a first flange abutting an exterior surface of the first side wall;

a second flange abutting the exterior surface of the first side wall;

a third flange abutting an exterior surface of one of the second side wall, the third side wall, and the fourth side wall;

a fourth flange abutting the exterior surface of the one of the second side wall, the third side wall, and the fourth side wall;

a first box-frame-segment removably attached to the post sleeve via at least one of the first flange and the second flange; and a second box-frame-segment removably attached to the post sleeve via at least one of the third flange and the fourth flange, wherein each of the first box-frame-segment and the second box-frame-segment comprises: (i) a first top horizontal element, (ii) a second top horizontal element, (iii) a third horizontal element, (iv) a first base horizontal element, (v) a first vertical element extending from the first base horizontal element to the second top horizontal element, (vi) a second vertical element extending from the first top horizontal element to the third horizontal element, (vii) a first locking tab extending upward from the third horizontal element to form a locking tab slot between the second vertical element and the first locking tab, and (viii) a second locking tab extending from and above the first base horizontal element.

2. The deck component of claim 1, wherein the post sleeve, the first flange, the second flange, the third flange, and the fourth flange are formed from a single metal extrusion.

3. The deck component of claim 1, wherein the post sleeve, the first flange, the second flange, the third flange, and the fourth flange are a single metal casting.

4. The deck component of claim 1, wherein the post sleeve is a metal extrusion or a metal casting, and wherein the first flange, the second flange, the third flange, and the fourth flange are welded to the post sleeve.

5. The deck component of claim 1, wherein the first flange is parallel to the second flange, and wherein the third flange is parallel to the fourth flange.

6. The deck component of claim 1, wherein the first side wall comprises a top edge, a bottom edge, a first side edge, and a second side edge, wherein the first flange and the second flange are offset from the first side edge of the first side wall and from the second side edge of the first side wall, wherein the one of the second side wall, the third side wall, and the fourth side wall comprises a top edge, a bottom edge, a first side edge, and a second side edge, and wherein the third flange and the fourth flange are offset from first side edge of the one of the second side wall, the third side wall, and the fourth side wall and from the second side edge of the one of the second side wall, the third side wall, and the fourth side wall.

7. The deck component of claim 6, wherein the first flange and the second flange are offset from top edge of the first side wall and from the bottom edge of the first side wall, and wherein the third flange and the fourth flange are offset from the top edge of the one of the second side wall, the third side wall, and the fourth side wall and from the bottom edge of the one of the second side wall, the third side wall, and the fourth side wall.

8. The deck component of claim 1, wherein the one of the second side wall, the third side wall, and the fourth side wall comprises the second side wall, but none of the third side wall and none of the fourth side wall.

9. The deck component of claim 1, wherein the one of the second side wall, the third side wall, and the fourth side wall comprises the third side wall, but neither of the second side wall and the fourth side wall.

10. The deck component of claim 1, wherein the first flange is thicker than the second flange, and the third flange is thicker than the fourth flange.

11. The deck component of claim 1, wherein the one of the second side wall, the third side wall, and the fourth side wall is the second side wall, wherein the component further comprises:

(i) a fifth flange abutting an exterior surface of the third side wall and a sixth flange abutting the exterior surface of the third side wall, and/or (ii) a seventh flange abutting an exterior surface of the fourth side wall and an eighth flange abutting the exterior surface of the fourth side wall.

12. The deck component of claim 1, wherein each of the first flange, the second flange, the third flange, and the fourth flange comprises a first flange surface, a second flange surface, a third flange surface, a fourth flange surface, a fifth flange surface, and an edge at which the first flange, the second flange, the third flange, and the fourth flange abuts the first side wall, wherein the first flange surface is opposite the second flange surface, wherein the third flange surface is opposite the edge, wherein the fourth flange surface is opposite the fifth flange surface, wherein the third flange surface and the edge extend from the first flange surface to the second flange surface, and from the fourth flange surface to the fifth flange surface, wherein the first flange surface and the second flange surface extend from the third flange surface to the edge and from the fourth flange surface to the fifth flange surface, wherein fourth flange surface and the fifth flange surface extend from first flange surface to the second flange surface and from the third flange surface to the edge, and wherein each of the first flange surface, the second flange surface, the third flange surface, the fourth flange surface, and the fifth flange surface is rectangular.

13. The deck component of claim 12, wherein a surface area of each of the fourth flange surface and the fifth flange surface is at least ten times larger than a surface area of each of the first flange surface, the second flange surface, and the third flange surface.

14. The deck component of claim 1, wherein at least one of the first box-frame-segment and the second box-frame-segment comprises a perimeter-trim-piece slot within the second top horizontal element adapted for retaining a removably retainable perimeter-trim-piece.

15. The deck component of claim 1, wherein at least one of the first box-frame-segment and the second box-frame-segment comprise a deck-clip slot adapted to retain a deck, and wherein the deck-clip slot provides access to screw splines for retaining a deck-clip screw positioned in the deck-clip slot of the at least one of the first box-frame-segment and the second box-frame-segment.

16. A deck component comprising:

a post sleeve comprising a first side wall, a second side wall, a third side wall, and a fourth side wall, wherein the first side wall abuts the second side wall and the third side wall, wherein the second side wall abuts the first side wall and the fourth side wall, wherein the third side wall abuts the first side wall and the fourth side wall, wherein the fourth side wall abuts the second side wall and the third side wall, and wherein a top of the post sleeve and a bottom of the post sleeve are open for accepting a post into the post sleeve;

a first flange abutting an exterior surface of the first side wall;

a second flange abutting the exterior surface of the first side wall;

a third flange abutting an exterior surface of one of the second side wall, the third side wall, and the fourth side wall; and a fourth flange abutting the exterior surface of the one of the second side wall, the third side wall, and the fourth side wall, wherein a distance from a bottom of the first side wall to the top of the first side wall is a first distance, wherein a distance from a bottom of the second side wall to the top of the second side wall is the first distance, wherein a distance from a bottom of the third side wall to the top of the third side wall is a second distance, wherein a distance from a bottom of the fourth side wall to the top of the fourth side wall is the second distance, wherein the second distance exceeds the first distance.

17. The deck component of claim 16, further comprising:

a first box-frame-segment removably attached to the post sleeve via at least one of the first flange and the second flange; and a second box-frame-segment removably attached to the post sleeve via at least one of the third flange and the fourth flange, wherein each of the first box-frame-segment and the second box-frame-segment comprises:

a first top horizontal element;

a second top horizontal element;

a third horizontal element;

a first base horizontal element, a first vertical element extending from the first base horizontal element to the second top horizontal element;

a second vertical element extending from the first top horizontal element to the third horizontal element;

a first locking tab extending upward from the third horizontal element to form a locking tab slot between the second vertical element and the locking tab; and a second locking tab extending from and above the first base horizontal element.

18. The deck component of claim 17, wherein at least one of the first box-frame-segment and the second box-frame-segment comprises a perimeter-trim-piece slot within the second top horizontal element adapted for retaining a removably retainable perimeter-trim-piece.

19. The deck component of claim 17, wherein at least one of the first box-frame-segment and the second box-frame-segment comprise a deck-clip slot adapted to retain a deck, and wherein the deck-clip slot provides access to screw splines for retaining a deck-clip screw positioned in the deck-clip slot of the at least one of the first box-frame-segment and the second box-frame-segment.

20. The deck component of claim 16, wherein (i) the post sleeve, the first flange, the second flange, the third flange, and the fourth flange are formed from a single metal extrusion, (ii) the post sleeve, the first flange, the second flange, the third flange, and the fourth flange are a single metal casting, or (iii) the post sleeve is a metal extrusion or a metal casting and the first flange, the second flange, the third flange, and the fourth flange are welded to the post sleeve.

* * * * *